US007811105B1

(12) United States Patent
Tan Chin Yaw et al.

(10) Patent No.: US 7,811,105 B1
(45) Date of Patent: Oct. 12, 2010

(54) ELECTRICAL CONNECTOR HOUSING WITH AN ACTUATOR TO RELEASE THE ELECTRICAL CONNECTOR HOUSING FROM AN ELECTRICAL CONNECTOR

(75) Inventors: Tommy Tan Chin Yaw, Singapore (SG); Chui Seng Ng, Singapore (SG); Michael Yash, Milford, MI (US)

(73) Assignee: J. S. T. Corporation, Farmington Hills, MI (US)

( * ) Notice: Subject to any disclaimer, the term of this patent is extended or adjusted under 35 U.S.C. 154(b) by 0 days.

(21) Appl. No.: 12/471,965

(22) Filed: May 26, 2009

(51) Int. Cl.
*H01R 13/62* (2006.01)

(52) U.S. Cl. ..... 439/157

(58) Field of Classification Search ..... 439/157, 439/372, 466, 468, 473, 901
See application file for complete search history.

(56) References Cited

U.S. PATENT DOCUMENTS 5,711,682 A * 1/1998 Maejima ..... 439/157
5,980,283 A * 11/1999 Okabe ..... 439/157
6,019,620 A * 2/2000 Kodama et al. ..... 439/157
6,053,780 A 4/2000 Ono et al.
6,056,582 A * 5/2000 Okabe ..... 439/372
6,312,273 B1 * 11/2001 Hasegawa et al. ..... 439/157
6,361,336 B1 * 3/2002 Zhao et al. ..... 439/157
6,575,784 B1 6/2003 Yamada
6,638,085 B1 * 10/2003 Martin ..... 439/157
6,739,888 B2 5/2004 Kato et al.
7,048,586 B2 5/2006 Ishizaki et al.
7,137,835 B2 11/2006 Shiga
7,150,640 B2 * 12/2006 Fukui et al. ..... 439/157
7,165,995 B2 1/2007 Fukushima et al.
7,234,952 B2 6/2007 Sasaki et al.

* cited by examiner

*Primary Examiner*—Chandrika Prasad
(74) *Attorney, Agent, or Firm*—Rader, Fishman & Grauer PLLC

(57) ABSTRACT

An electrical connector housing includes a housing body and a lever. The housing body has a base panel member, a pair of opposing side walls, a forward side wall and a rearward side wall connected to each other to form a generally box-shaped cavity. The lever has a pair of lever arms disposed apart from and extending parallel to one another and a main cross-member interconnecting the pair of lever arms to form a generally U-shaped configuration. The pair of lever arms straddle the base panel member with the pair of lever arms pivotably connected to the pair of opposing side walls for angularly moving about a pivot axis between a first position where the pair of lever arms extend generally parallel to the pair of opposing side walls and a second position where the pair of lever arms are disposed angularly relative to the pair of opposing side walls.

41 Claims, 24 Drawing Sheets

ELECTRICAL CONNECTOR HOUSING WITH AN ACTUATOR TO RELEASE THE ELECTRICAL CONNECTOR HOUSING FROM AN ELECTRICAL CONNECTOR

FIELD OF THE INVENTION

The present invention relates to an electrical connector housing. More particularly, the present invention is directed to an electrical connector housing having a lever.

BACKGROUND OF THE INVENTION

There are a variety of types of electrical connectors that are known in the art. One such electrical connector is described in U.S. Pat. No. 7,150,640 to Fukui et al. This invention is a lever type connector that includes a connector housing, an extended wall, a cover, a lever, a lever locking portion and an engaging portion. The connector housing receives a terminal of an electric wire. The extended wall is disposed on an upper base plate of the connector housing. The cover is slid inside the extended wall and is attached to the connector housing. The cover guides and leads the electric wire. The lever is rotatably attached to the connector housing. The lever locking portion is disposed on a portion of the cover for engaging with a part of the lever. The locking portion is flexible and arm shaped. The locking protrusion is disposed on the cover for locking the cover to the connector housing. The engaging portion is disposed on the connector housing for engaging with the locking protrusion. The cover has an electric wire holder rib disposed at and protruding from a rear surface of the cover and abuts to the electric wire so as to prevent the electric wire from interfering with a clearance, which allows a downward movement of the lever locking portion.

U.S. Pat. No. 7,048,586 to Ishizaki et al. discloses a shield connector. The shield connector includes a conductive connector housing, a shielded wire extended from the connector housing and a conductive shielding terminal. The shielded wire includes a conductor electrically connected to a mating terminal, an insulative sheath covering the conductor and a conductive shielding member covering the sheath. The conductive shielding terminal includes a first plate, a conductive second plate and a plurality of fixing members. The first plate is disposed on the connector housing and has a first through hole through which the shielded wire passes and a contact portion which is in contact with the shielding member. The conductive second plate has a second through hole through which the shielded wire passes. The plurality of fixing members fixes the first plate and the second plate on the connector housing such that the first plate is pressed by the second plate against the connector housing.

U.S. Pat. No. 7,165,995 to Fukushima et al. discloses an electromagnetic interference shielded connector. The electromagnetic interference shielded connector includes a plurality of electric wires, a connector housing and a metallic shielding shell. The plurality of electric wires has connecting parts at the respective ends of the electric wires. The connector housing contains the electric wires and the connecting parts. The metallic shielding shell includes a cylindrical electric-wire drawn-out portion and a terminal drawn-out portion. The electric wires are drawn out through cylindrical electric-wire drawn-out portion. The connecting parts are protruded from the terminal drawn-out portion. The connector housing is formed by an entire molding so as to fill a resin inside of the metallic shielding shell in a state that the electric wires are inserted through the electric-wire drawn-out portion and the connecting parts are drawn out through the terminal drawn-out portion.

These prior art connectors are not conducive for high voltage or high current applications. Also, these prior art connectors do not accept blade-type male terminals nor can they meet class 4 vibration standards.

OBJECTS AND SUMMARY OF THE INVENTION

An electrical connector housing of the present invention is hereinafter described. The electrical connector housing includes a housing body and a lever. The housing body has a generally rectangular base panel member and pair of opposing side walls connected to the base panel member, a forward side wall connected between the pair of opposing sidewalls and to the base panel member and a rearward side wall disposed apart from the forward side wall and connected between the pair of opposing side walls and the base panel to form an opening into a generally box-shaped cavity.

The lever has a pair of lever arms disposed apart from and extending parallel to one another and a main cross-member interconnecting the pair of lever arms to form a generally U-shaped configuration. The pair of lever arms straddle the base panel member with respective ones of the pair of lever arms pivotably connected to respective ones of the pair of opposing side walls for angularly moving about a pivot axis to and between a first position where the pair of lever arms extend generally parallel to the pair of opposing side walls and a second position where the pair of lever arms are disposed angularly relative to the pair of opposing side walls.

The electrical connector housing is adapted for moving an electrical assembly mounting block away from a surface while at least partially withdrawing mated electrical terminals from one another. With the lever in the first position, the electrical connector housing and the surface contact one another and the electrical terminals are substantially matably engaged with one another. With the lever moving from the first position to the second position, the lever, being in contact with the surface, causes the electrical connector housing and the surface to move apart from one another thus causing the electrical terminals to be at least partially withdrawn from being substantially matably engaged with one another.

Another embodiment of the invention is an electrical connector adapted for electrically connecting a wire assembly and a power supply. The wire assembly includes a wire assembly block retainer having a plurality of flexible latches and retaining a plurality of wire structures thereto. Each one of the plurality of wire structures has a wire and with a female blade-receiving terminal electrically and mechanically attached to a terminal end of respective ones of the wires. The power supply has a plurality of hot terminals operably connected thereto. The electrical connector includes an electrical assembly that has the electrical assembly mounting block, the housing body and the lever and an electrical assembly plate member.

The electrical assembly mounting block is sized and adapted to receive and retain the plurality of wire structures and the female blade-receiving terminals therein. The housing body is connected to and covers the electrical assembly mounting block. The housing body has a generally rectangular base panel member and pair of opposing side walls connected to the base panel member, a forward side wall connected between the pair of opposing sidewalls and to the base panel member and a rearward side wall disposed apart from the forward side wall and connected between the pair of opposing side walls and the base panel to form an opening into a generally box-shaped cavity sized to receive the electrical assembly mounting block therein.

The lever is pivotably connected to the connector body and operative to angularly move about the pivot axis from a first position to a second position. The lever has a pair of lever arms that are disposed apart from and extends parallel to one another and a main cross-member that interconnect the pair of lever arms to form a generally U-shaped configuration. The pair of lever arms straddle the base panel member. Respective ones of the pair of lever arms are pivotably connected to respective ones of the pair of opposing side walls.

The electrical assembly plate member is sized and adapted for the placement of the electrical assembly thereon. The electrical assembly plate member has a plurality of hot terminal holes formed therethrough sized to receive respective ones of the plurality of hot terminals.

With the lever in the first position, the electrical connector assembly and the electrical assembly plate member contact one another and the plurality of female blade-receiving terminals receiving respective ones of the plurality of hot terminals therein in a substantially matably engaged relationship with one another. Moving the lever from the first position to the second position, the lever is in contact with the electrical assembly plate member to cause the electrical connector assembly and the electrical assembly plate member to move apart from one another thus causing the plurality of female blade-receiving terminals and the plurality of hot terminals to be at least partially withdrawn from being in the substantially matably engaged relationship with one another.

DETAILED DESCRIPTION OF THE EXEMPLARY EMBODIMENTS

Hereinafter, embodiments of the present invention will be described with reference to the attached drawings. The structural components common to those of the prior art and the structural components common to respective embodiments of the present invention will be represented by the same symbols and repeated description thereof will be omitted.

Figure 1:
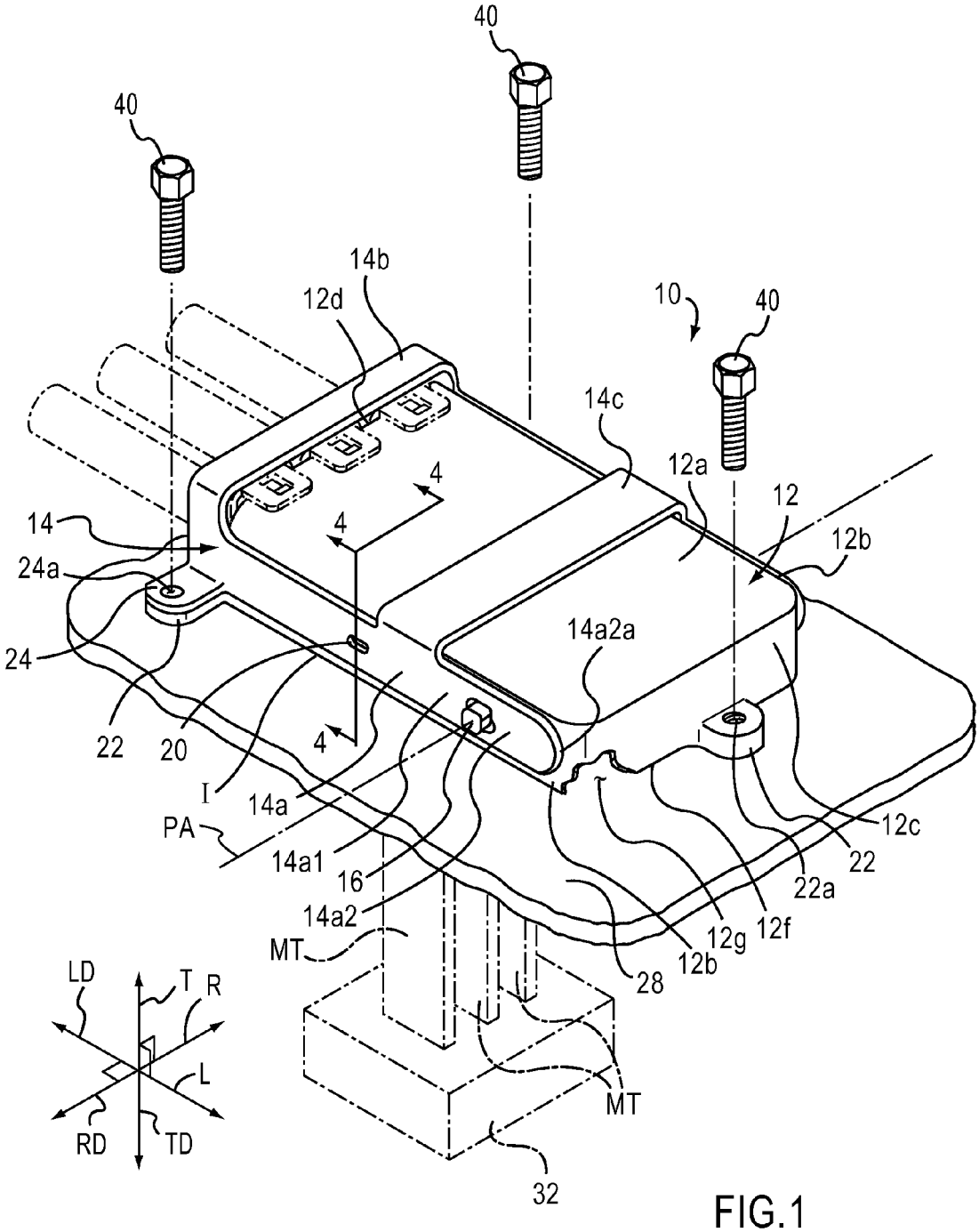
FIG. 1 is a perspective view of a first exemplary embodiment of an electrical connector housing of the present invention disposed on a surface and electrically connected to a power supply.
Figure 2:
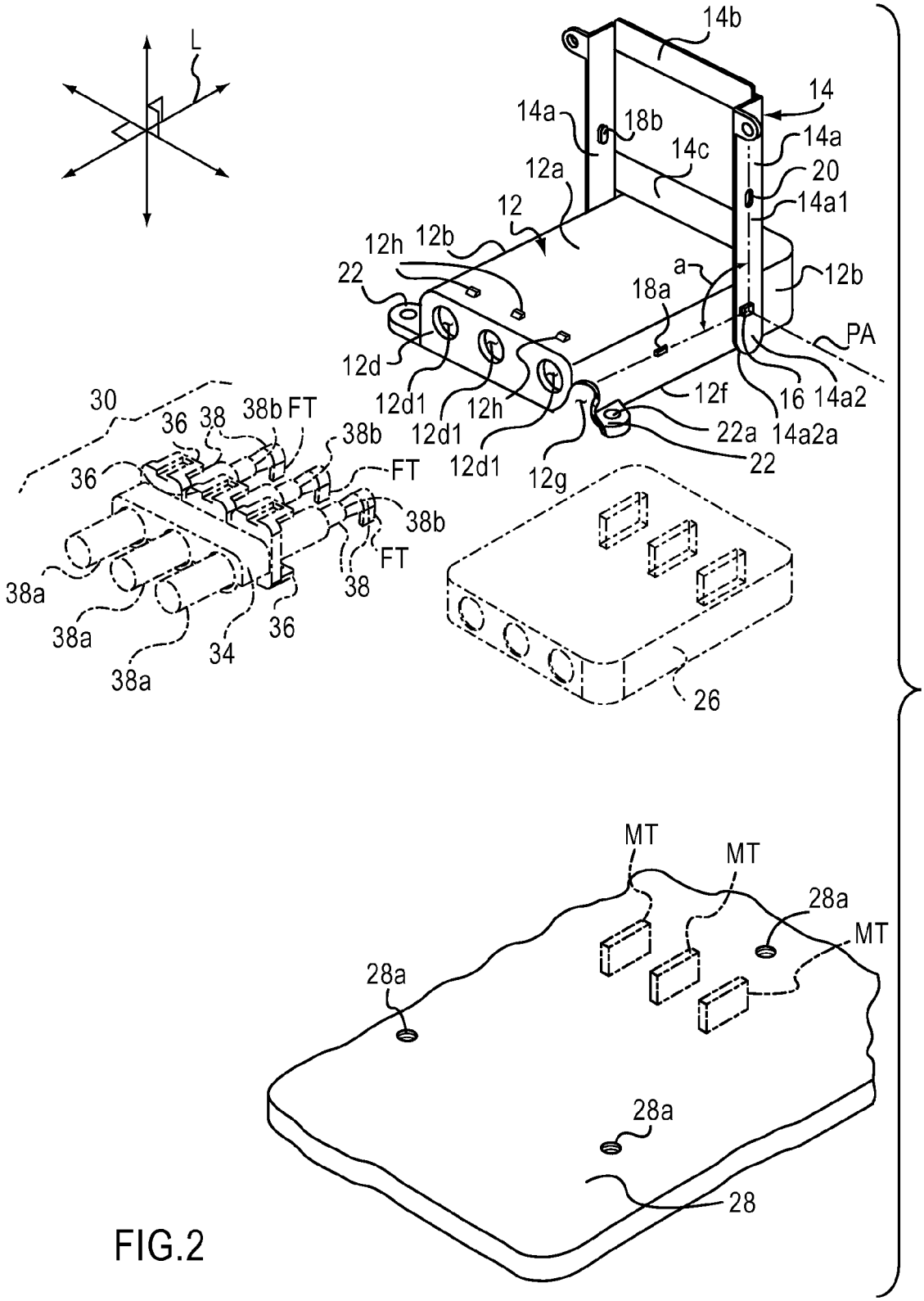
FIG. 2 is an exploded perspective view of the electrical connector housing of the present invention.
Figure 3:
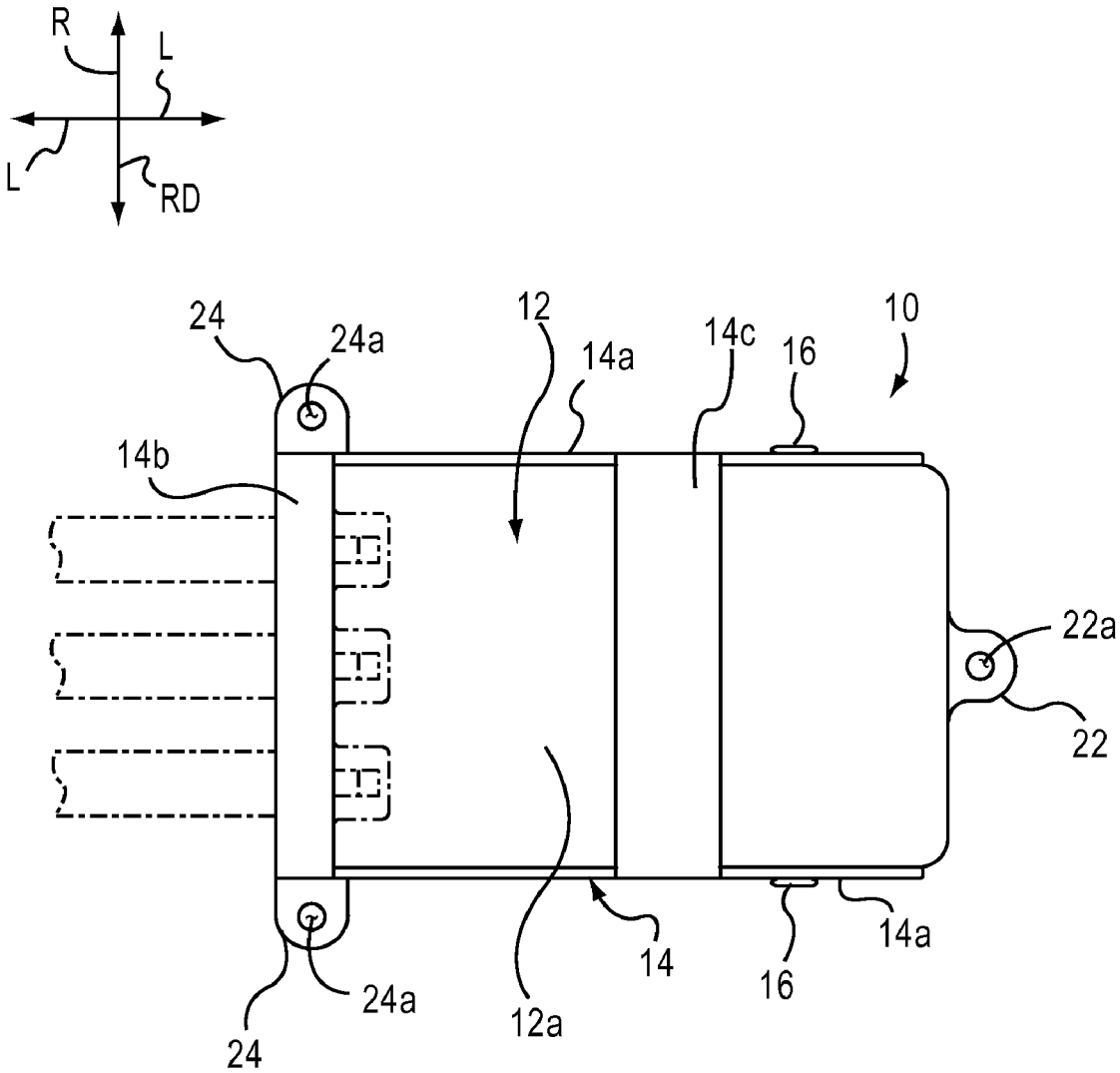
FIG. 3 is a top plan view of the electrical connector housing of the present invention.

A first exemplary embodiment of an electrical connector housing 10 of the present invention is hereinafter described with reference to FIGS. 1-9. As best shown in FIGS. 1 and 2, the electrical connector housing 10 includes a housing body 12 and a lever 14. The housing body 12 extends along and about a longitudinal axis L, a lateral axis R and a transverse axis T. The longitudinal axis L, the lateral axis R and the transverse axis T perpendicularly intersect one another to form a conventional Cartesian coordinate system. The longitudinal axis L defines a longitudinal direction LD, the lateral axis R defines a lateral direction RD and the transverse axis T defines a transverse direction TD. The housing body 12 has a generally rectangular base panel member 12*a* and pair of opposing side walls 12*b* that are connected to the base panel member 12*a*. A forward side wall 12*c* is connected between the pair of opposing sidewalls 12*b* and to the base panel member 12*a*. A rearward side wall is disposed apart from the forward side wall 12*c* and is connected between the pair of opposing side walls 12*b* and the base panel 12*a* to form an opening 12*f* into a generally box-shaped cavity 12*g*

Again, with reference to FIGS. 1 and 2, the lever 14 has a pair of lever arms 14*a* that are disposed apart from and extending parallel to one another and a main cross-member 14*b*. The main cross-number 14*b* interconnects the pair of lever arms 14*a* to form a generally U-shaped as best shown in FIG. 2. Note that the pair of lever arms 14*a* straddle the base panel member 12*a*. Respective ones of the pair of lever arms 14*a* are pivotably connected to respective ones of the pair of opposing side walls 12*b* for angularly moving about a pivot axis PA to and between a first position (FIG. 1) and a second position (represented in FIG. 2). In the first position (FIG. 1), the pair of lever arms 14*a* extend generally parallel to the pair of opposing side walls 12*b*. In the second position (FIG. 2), the pair of lever arms 14*a* are disposed angularly relative to the pair of opposing side walls 12*b* as represented by angle a shown in FIG. 2. As illustrated in FIG. 1, the main cross member 14*b* extends beyond the rearward wall 12*d* when the lever is in the first position. In other words, the main cross member 14*b* extends beyond the housing body 12.

Again, with reference to FIGS. 1 and 2, the electrical connector housing 10 also includes a pair of pivot pins 16. Respective ones of the pair of pivot pins 16 pivotably connect respective ones of the pair of lever arms 14*a* to the respective ones of the pair of opposing side walls 12*b*. Each one of the pair of lever arms 14*a* includes a lever arm extension portion 14*a*1 and a lever arm free end portion 14*a*2. The lever arm extension portion 14*a*1 extends between the main cross-member 14*b* and the respective pivot pin 16. The lever arm free end portion 14*a*2 extends from the respective pivot pin 16 and terminates in a free end 14*a*2*a*.

By way of example only and not by way of limitation, the first exemplary embodiment of the electrical connector housing 10 also includes a secondary cross-member 14*c*. The secondary cross-member 14*c* interconnects the pair of lever arms 14*a* and is disposed between the main cross-member 14*b* and the pivot axis PA as best shown in FIG. 1.

Figure 4:
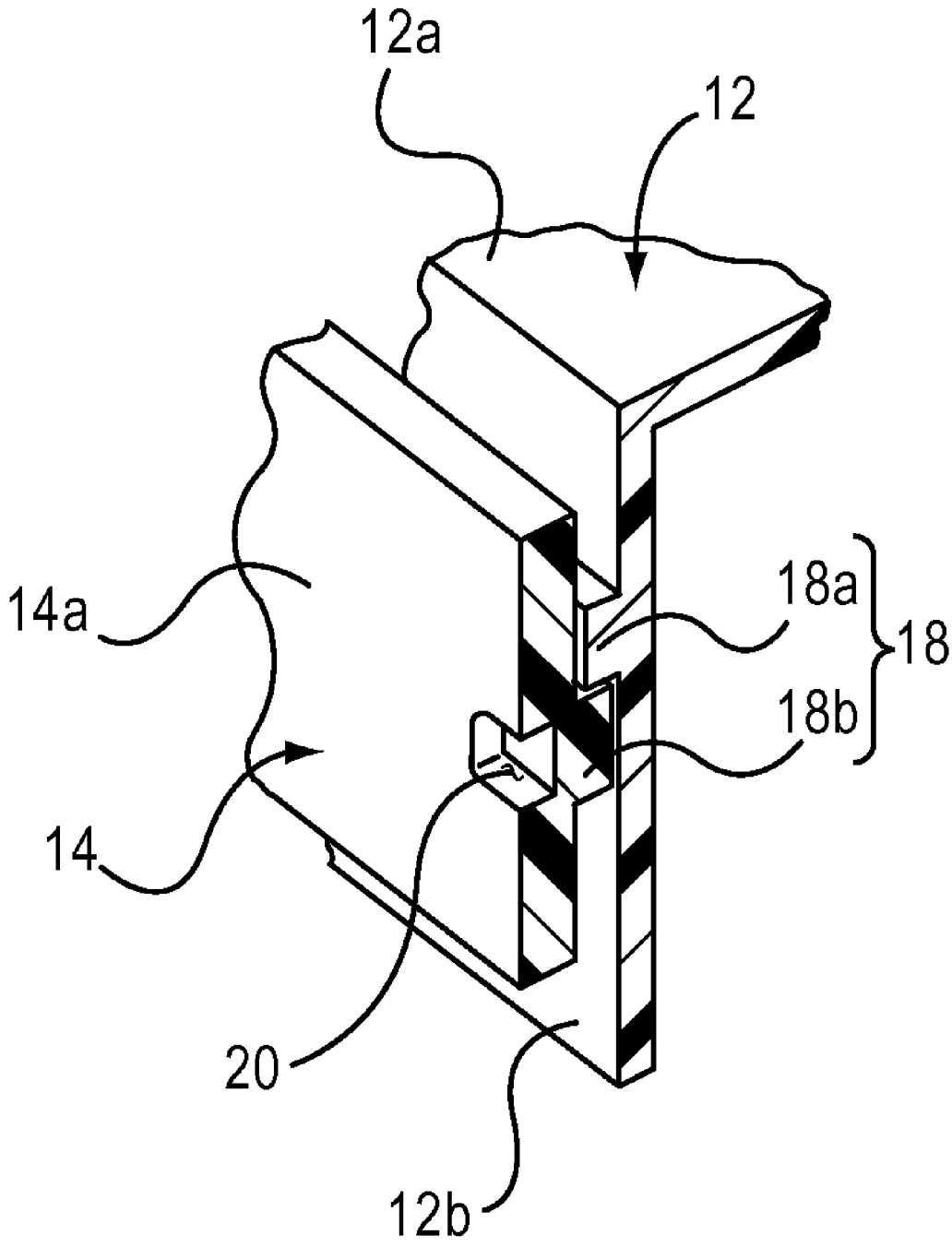
FIG. 4 is a partial perspective view of a retainer device taken along line 4-4-4 in FIG. 1.

Furthermore, with reference to FIG. 4, the electrical connector housing 10 includes a pair of retainer devices 18. Each retainer device 18 is operative for releasably retaining the lever 14 in the first position (FIG. 1). Each retainer device 18 includes a housing boss 18*a* that is connected the opposing side wall 12*b* of the housing body 12 and a lever boss 18*b* that is connected to the lever arm 14*a* of the lever 14. When the lever 14 is in the first position (FIG. 1), the housing boss 18*a* and the lever boss 18*b* overlap and contact one another in a manner to inhibit angular movement of the lever 14 from the first position (FIG. 1). A recess 20 is formed into respective ones of the pair of lever arms 14*a* as an indicator where the pair of retainer devices 18 are located. Additionally, one of ordinary skill in the art would appreciate that rather than having a pair of retainer devices 18, it is only necessary to have at least one retainer device 18 to releasably retain the lever 14 in the first position (FIG. 1).

With reference to FIGS. 1 and 2, the housing body 12 includes three housing fastener tabs 22. Each one of the three housing fastener tabs 22 is connected to and project from the housing body 12. Two of the three housing fastener tabs 22 project in the lateral direction RD and are positioned on respective ones of the pair of opposing side walls 12*b* adjacent the respective corners formed by the rearward side wall 12*b* and the pair of opposing side walls 12*b*. One of the three housing fastener tabs 22 extends along the longitudinal direction LD and is connected centrally along the forward side wall 12*c*. Each housing fastener tab 22 has a housing fastener tab hole 22*a* that extends through the housing fastener tab 22. Further, the lever 14 includes a pair of lever fastener tabs 24. Each one of the pair of lever fastener tabs 24 has lever fastener tab hole 24*a* formed therethrough. In the first position (FIG. 1) respective ones of the pair of lever fastener tabs 24 are positioned on two selected ones of the three housing fastener tabs 22, which, in this case, are the two housing fastener tabs 22 projecting in the lateral direction LD.

Correspondingly, in the first position (FIG. 1), respective ones of the housing fastener tab holes 22*a* and lever fastener tab holes 24*a* are in registration with one another when the respective ones of the pair of lever fastener tabs 24 are positioned on the two selected ones of the three housing fastener tabs 22. As is known by one of ordinary skill in the art, the housing body 12 includes at least three housing fastener tabs 22 so that the electrical connector housing 12, when fastened to a support surface, complies with class 4 vibration standards.

As illustrated in FIGS. 2 and 5A-9, the electrical connector housing 10 is adapted for moving a conventional electrical assembly mounting block 26 away from a surface 28 while at least partially withdrawing conventional mated electrical terminals MET's (only one MET shown in FIGS. 5B, 6B, 7B and 8B) from one another. A skilled artisan would comprehend that each conventional mated electrical terminal MET includes a female terminal FT and a male terminal MT as best shown in FIG. 1. Each male terminal MT is electrically connected to a power supply 32 as shown in FIG. 1 and each male terminal MT is considered an electrically hot terminal. Further, as is known by one of ordinary skill in the art, the conventional electrical assembly mounting block 26 is sized and adapted to receive and retain a conventional wire assembly 30 and, by way of example only, the female terminals FT are the female blade-receiving terminals therein and the male terminals MT are blade terminals. The wire assembly 30 includes a wire assembly block retainer 34 that has a plurality of flexible latches 36 and retains a plurality of wire structures 38 thereto. Each one of the plurality wire structures 38 has a wire 38*a* and includes the female terminal FT, i.e., the female blade-receiving terminal, that is electrically and mechanically attached to a terminal end 38*b* of respective ones of the wires 38*a*. The rearward side wall 12*d* has rearward side wall holes 12*d*1 formed therethrough so the housing body 12 and the conventional electrical assembly mounting block 26 can receive the wire structures 38.

Figure 5A:
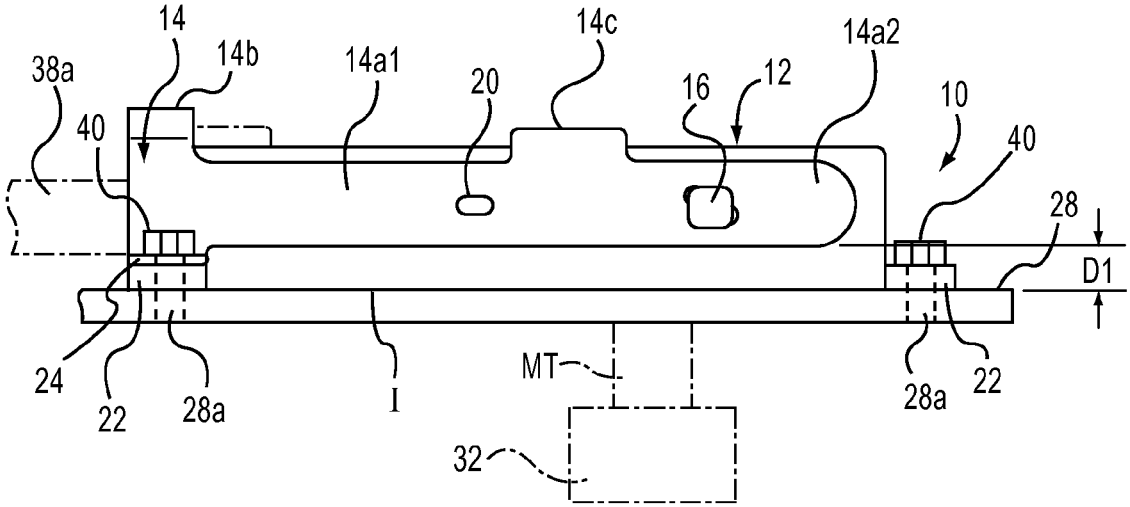
FIG. 5A is a side elevation view of the electrical connector of the present invention with a lever pivotably connected to a housing body with the lever in a first position and the housing body releasably fastened to a surface by conventional fasteners.

Particularly with reference to FIGS. 5A-9, the electrical connector housing 10 is adapted for moving the electrical assembly mounting block 26 away from the surface 28 while at least partially withdrawing the mated electrical terminals MET's from one another. The housing body 12 is connected to the electrical assembly mounting block 26 by any conventional manner and covers the electrical assembly mounting block 26. In FIGS. 5A and 5B, the electrical connector housing 10 is fastened to the surface 28 by conventional fasteners 40 such as screws. Note that the fasteners 40 extend through the lever fastener tabs 24 through the lever fastener tab holes 24*a* and though the housing fastener tabs 22 through the housing fastener tab holes 22*a* and thereafter into surface holes 28*a*. In FIGS. 6A and 6B, the fasteners 40 are removed from the lever fastener tab holes 24*a*, the housing fastener tab holes 22*a* and the surface holes 28*a*.

Figure 5B:
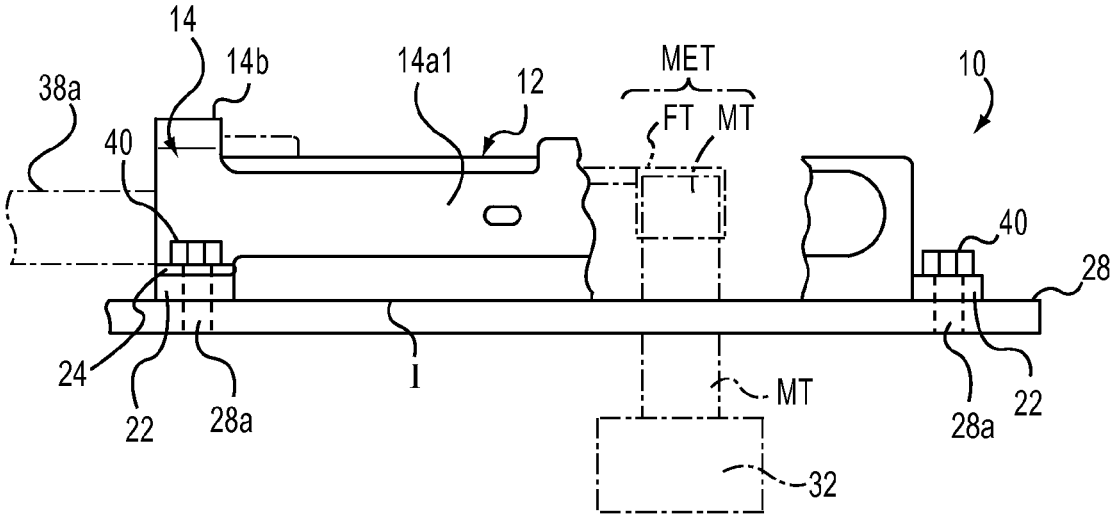
FIG. 5B is a partially broken-away side elevation view of the electrical connector of the present invention as shown in FIG. 5A diagrammatically illustrating the electrical terminals being at least substantially matably engaged with one another.
Figure 6A:
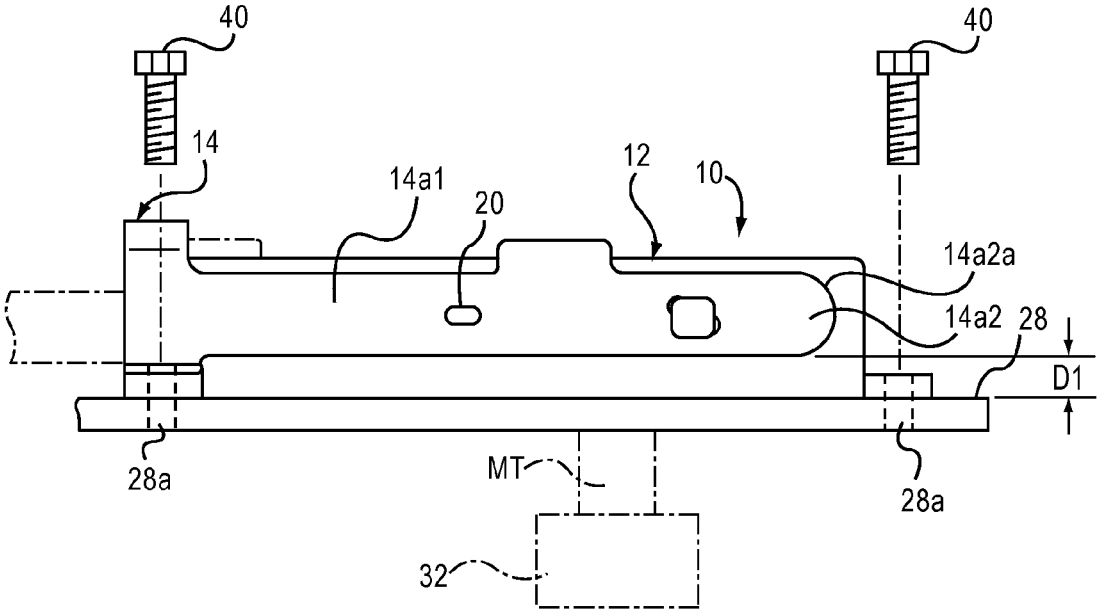
FIG. 6A is a side elevation view of the electrical connector of the present invention with a lever pivotably connected to the housing body in the first position and the conventional fasteners removed from the housing body and the surface.
Figure 6B:
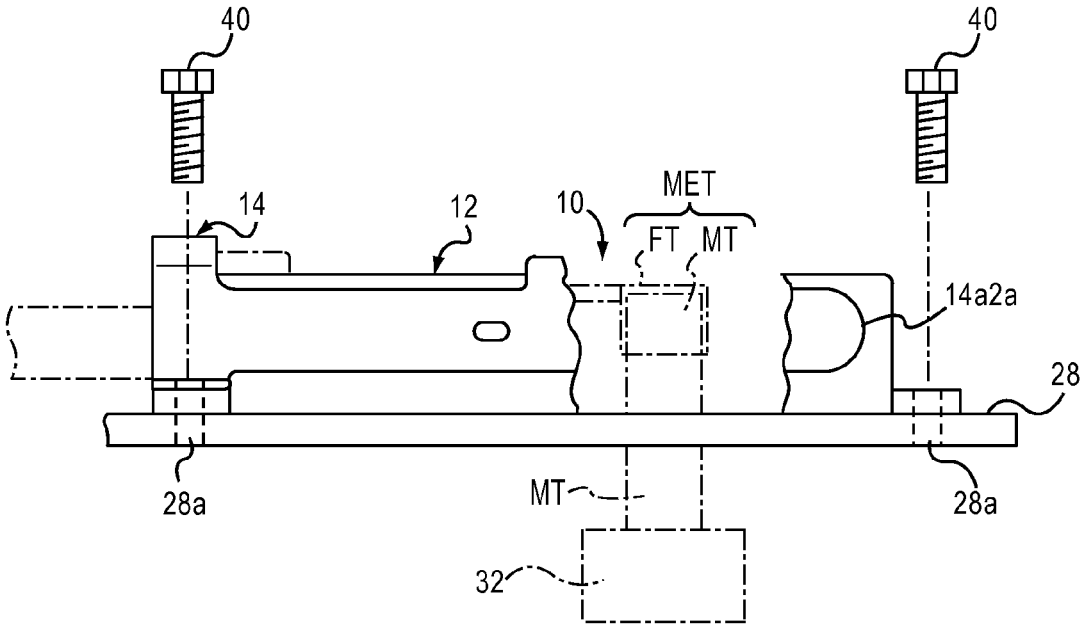
FIG. 6B is a partially broken-away side elevation view of the electrical connector of the present invention as shown in FIG. 6A diagrammatically illustrating the electrical terminals being at least substantially matably engaged with one another.
Figure 8A:
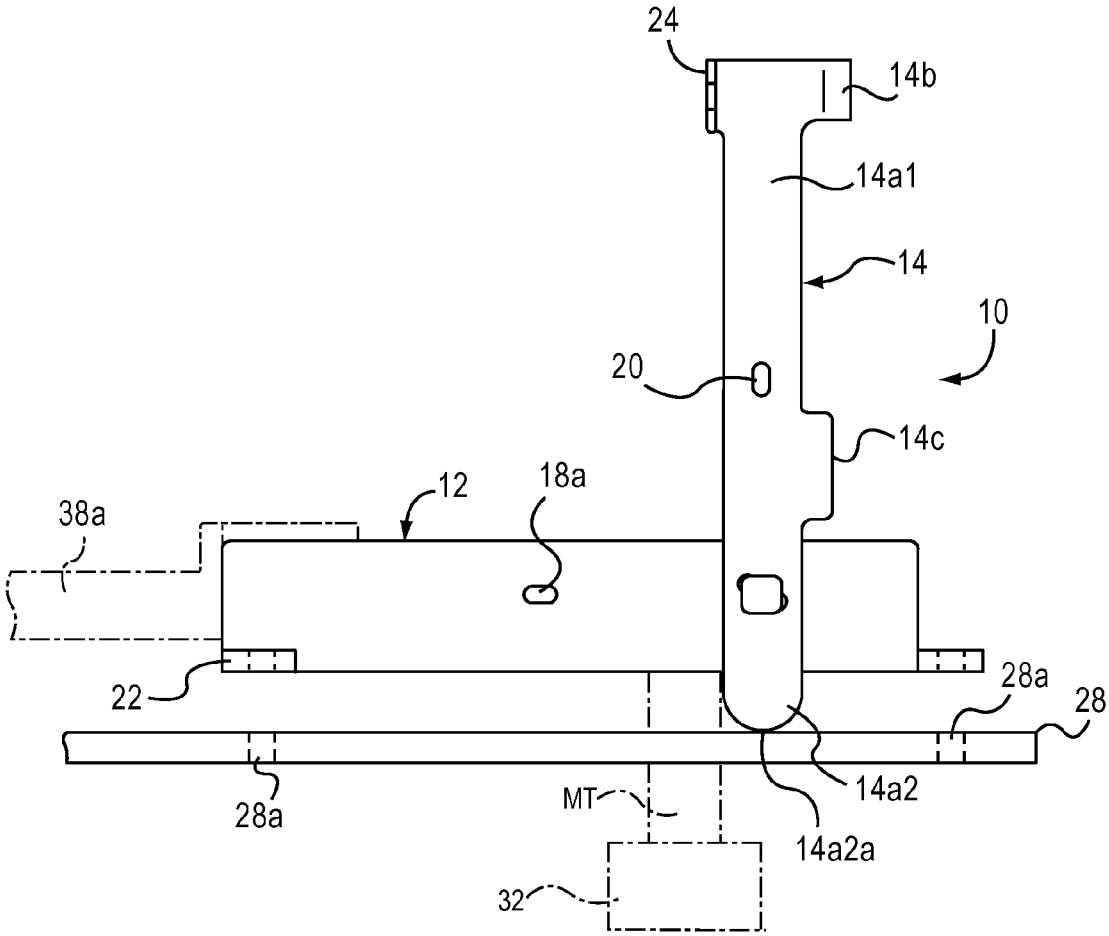
FIG. 8A is a side elevation view of the electrical connector of the present invention with a lever pivotably connected to the housing body in a second position contacting the surface.\
Figure 8B:
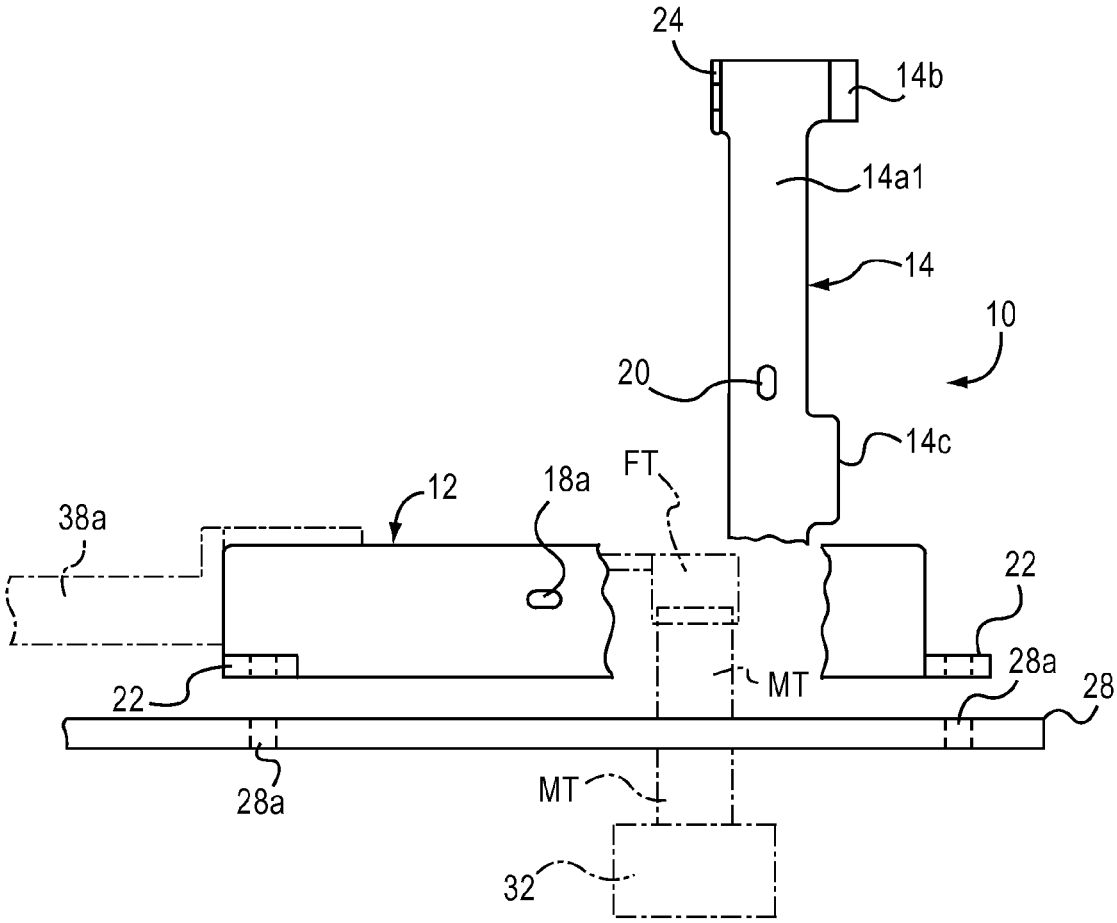
FIG. 8B is a partially broken-away side elevation view of the electrical connector of the present invention as shown in FIG. 8A diagrammatically illustrating the electrical terminals being at least partially withdrawn from matable engagement with one another.

With the lever in the first position (FIGS. 1 and 5A-6B), the electrical connector housing 10 and the surface 28 contact one another at the interface I and the mated electrical terminals MET's (female terminal FT and male terminal MT) are substantially matably engaged with one another as illustrated in FIGS. 5B and 6B. The lever 14 is moved from the first position (FIGS. 1 and 5A-6B) to the second position (FIGS. 8A and 8B). During this movement, the lever 14 is in contact with the surface 28 and, as a result, causes the electrical connector housing 10 and the surface 28 to move apart from one another thus causing the mated electrical terminals MET to be at least partially withdrawn from being substantially matably engaged with one another as shown in FIG. 8B. As discussed in more detail below, the free end 14*a*2*a* contacts the surface 28 when the lever 14 angularly moves from the first position to the second position.

Figure 7A:
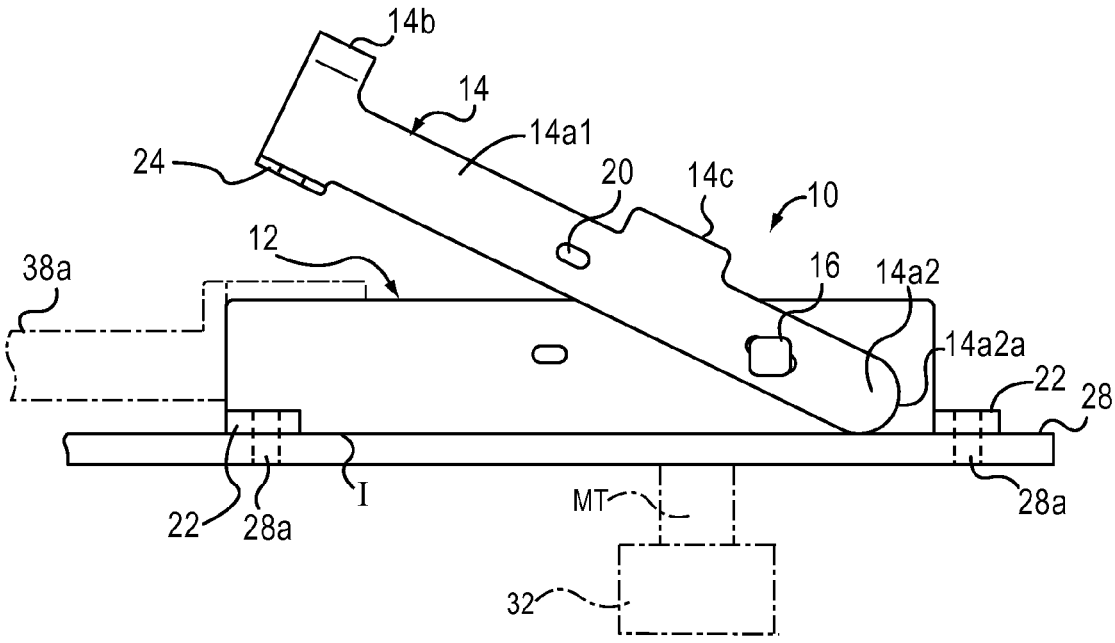
FIG. 7A is a side elevation view of the electrical connector of the present invention with the lever pivotably connected to the housing body in an intermediate position contacting the surface.
Figure 7B:
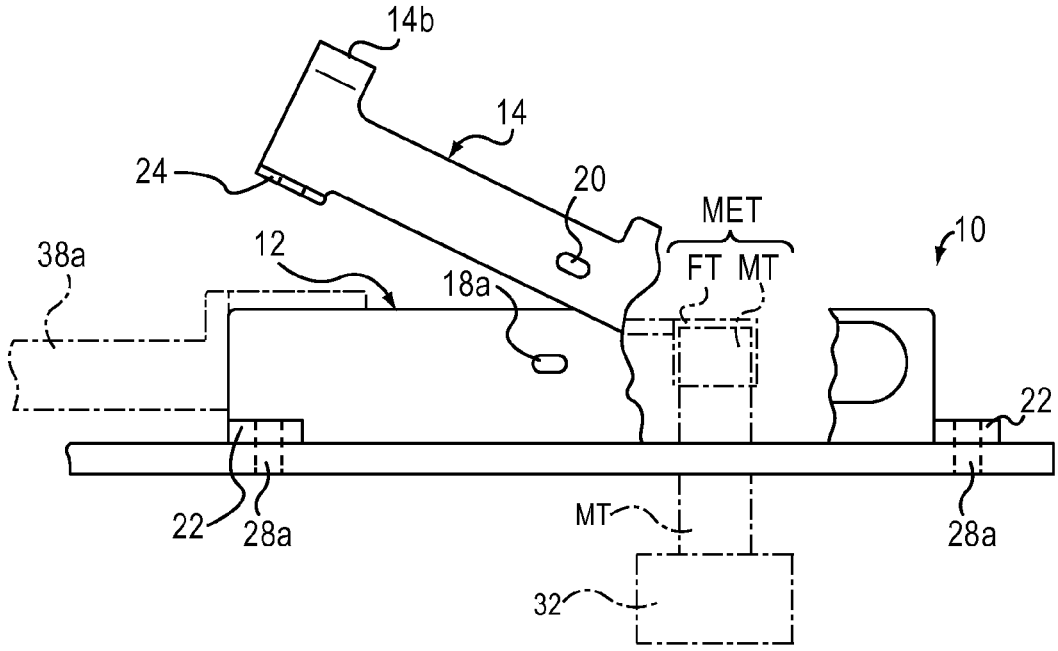
FIG. 7B is a partially broken-away side elevation view of the electrical connector of the present invention as shown in FIG. 7A diagrammatically illustrating the electrical terminals being at least substantially matably engaged with one another.
Figure 9:
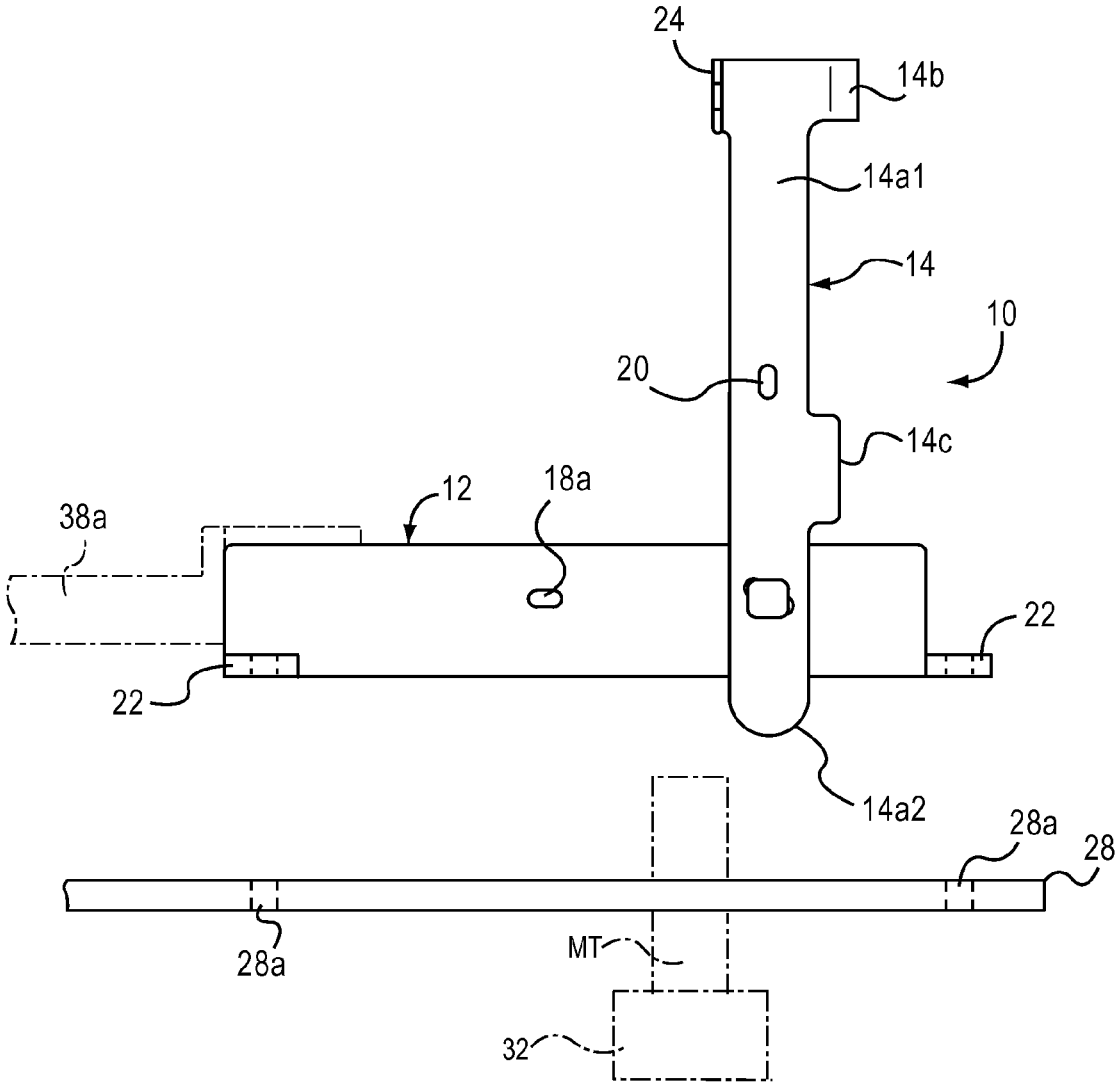
FIG. 9 is a side elevation view of the electrical connector of the present invention disposed apart from the surface and the electrical terminals being completely disengaged from one another.
Figure 10:
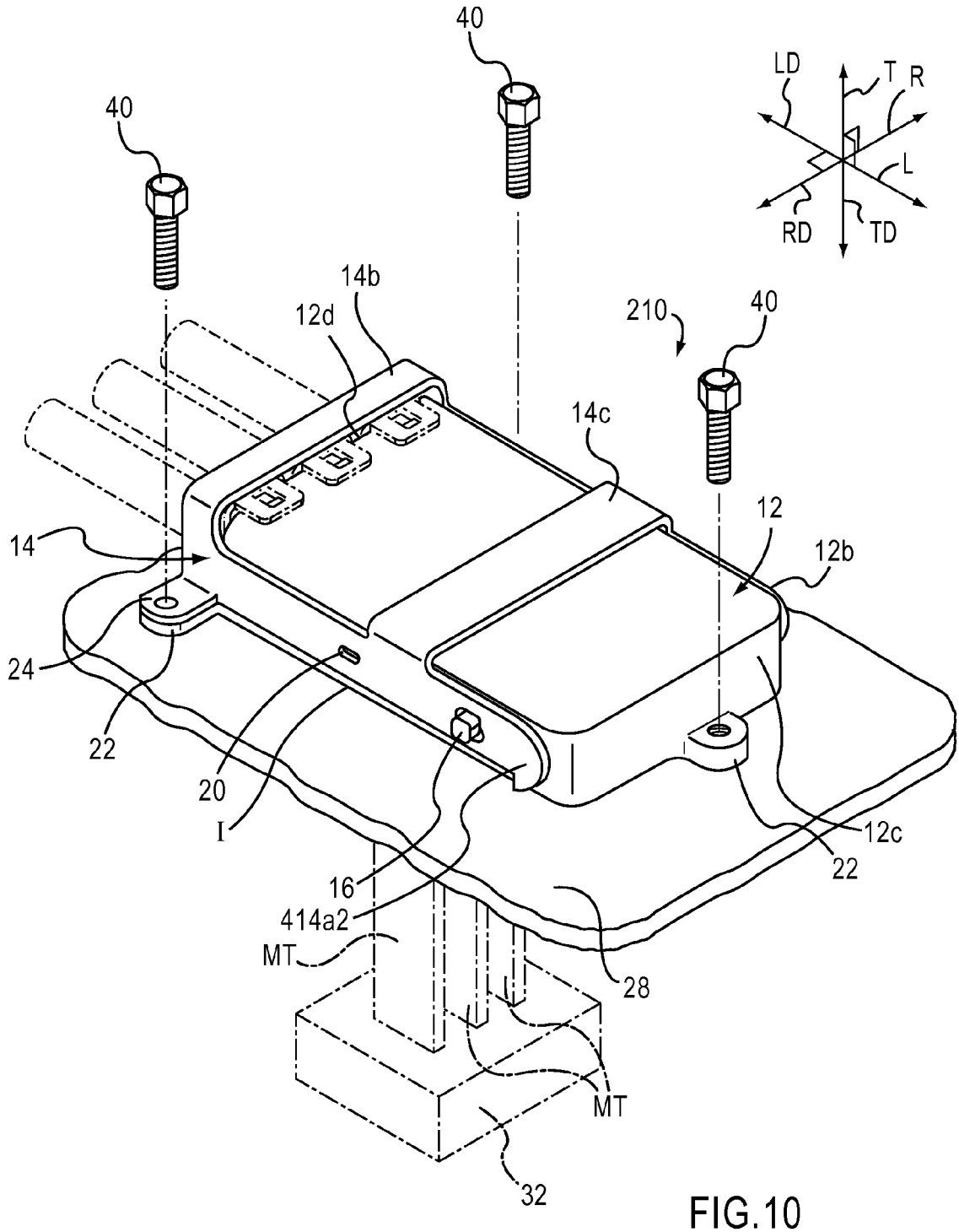
FIG. 10 is a perspective view of a second exemplary embodiment of an electrical connector housing of the present invention disposed on a surface and electrically connected to a power supply with a lever having a cam element.
Figure 11A:
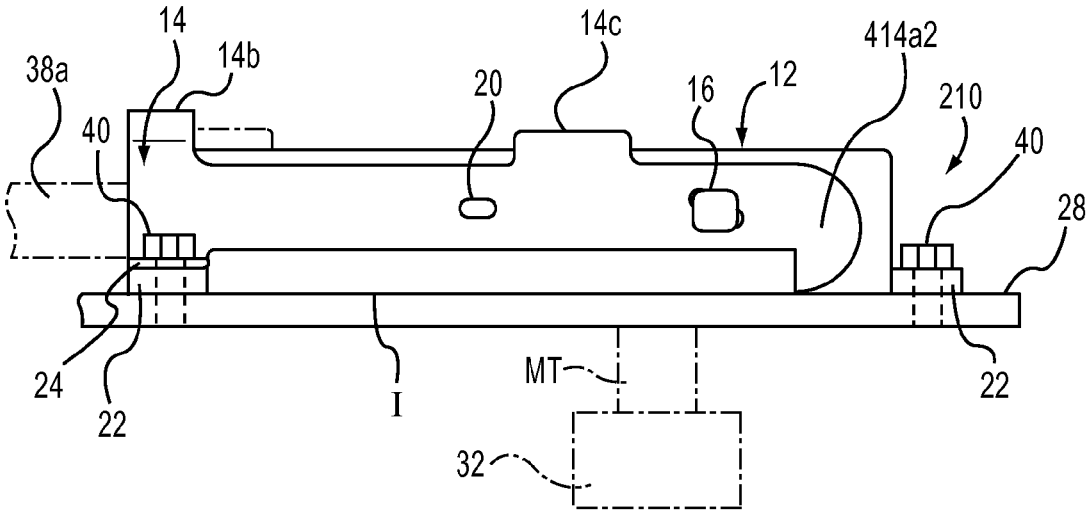
FIG. 11A is a side elevation view of the electrical connector of the present invention in FIG. 10 with the lever pivotably connected to the housing body in the first position and the housing body releasably fastened to a surface by the conventional fasteners.
Figure 11B:
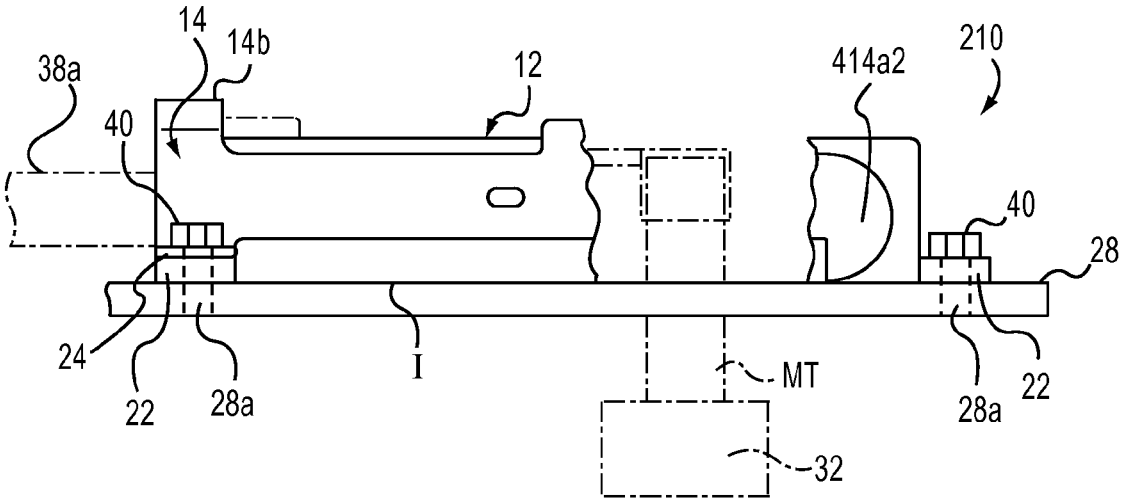
FIG. 11B is a partially broken-away side elevation view of the electrical connector of the present invention as shown in FIG. 11A diagrammatically illustrating the electrical terminals being at least substantially matably engaged with one another.
Figure 12A:
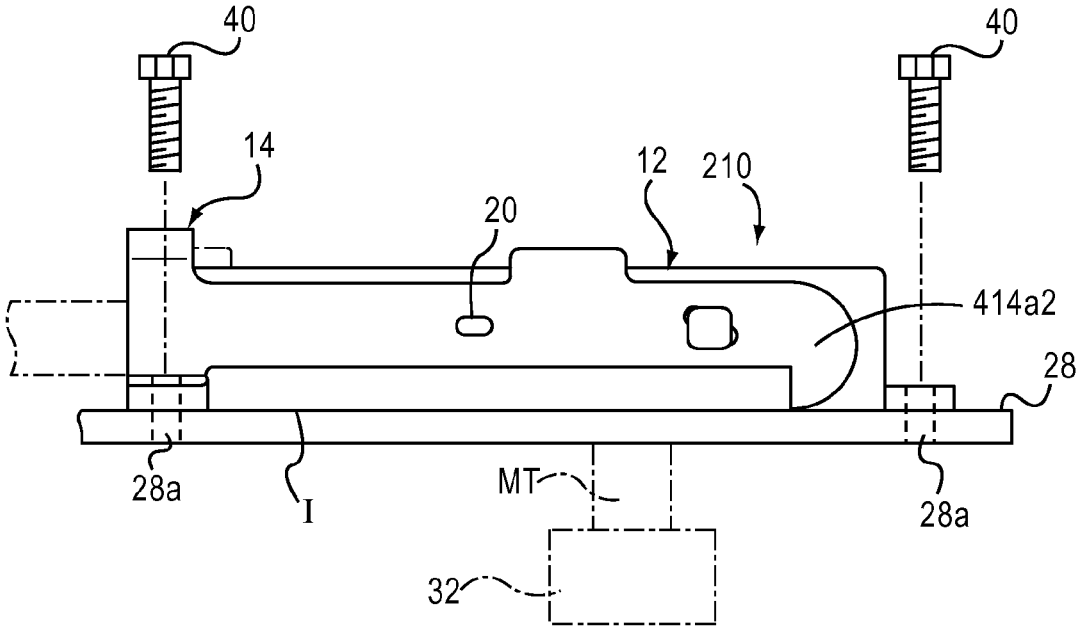
FIG. 12A is a side elevation view of the electrical connector of the present invention in FIG. 10 with the lever pivotably connected to the housing body in the first position and having a cam element adjacent to or in contact with the surface and the conventional fasteners removed from housing body and the surface.
Figure 12B:
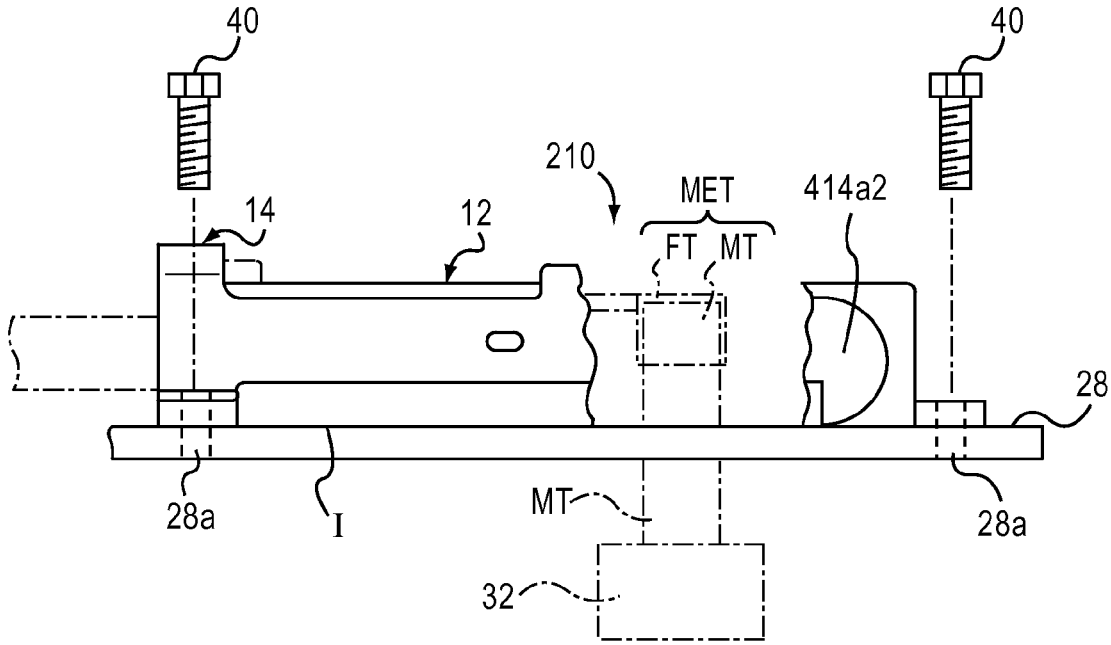
FIG. 12B is a partially broken-away side elevation view of the electrical connector of the present invention as shown in FIG. 12A diagrammatically illustrating the electrical terminals being at least substantially matably engaged with one another.
Figure 13A:
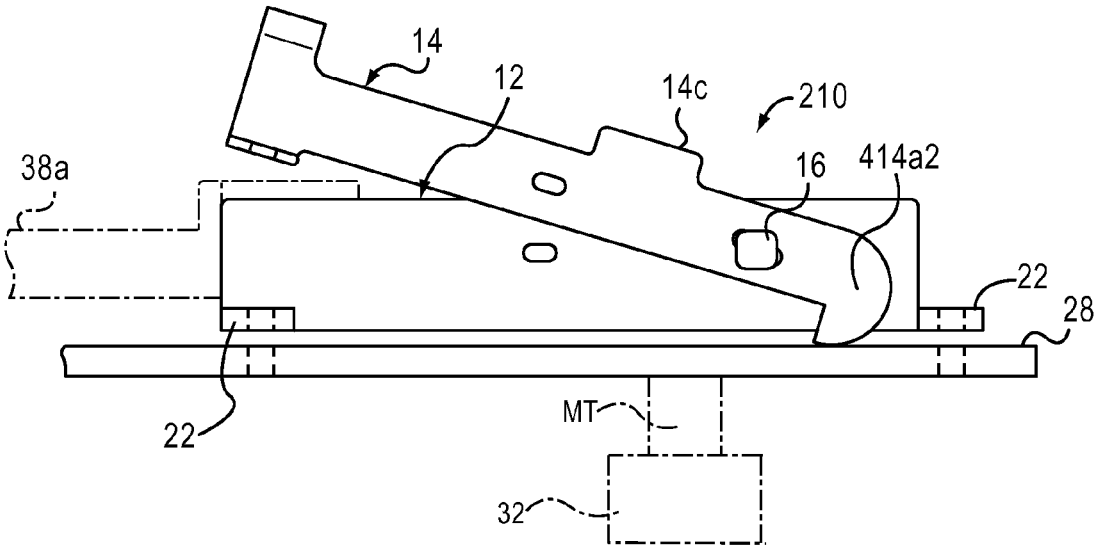
FIG. 13A is a side elevation view of the electrical connector of the present invention with the lever pivotably connected to the housing body in a first intermediate position with the cam element being in contact the surface and separating the housing body and the surface from one another.
Figure 13B:
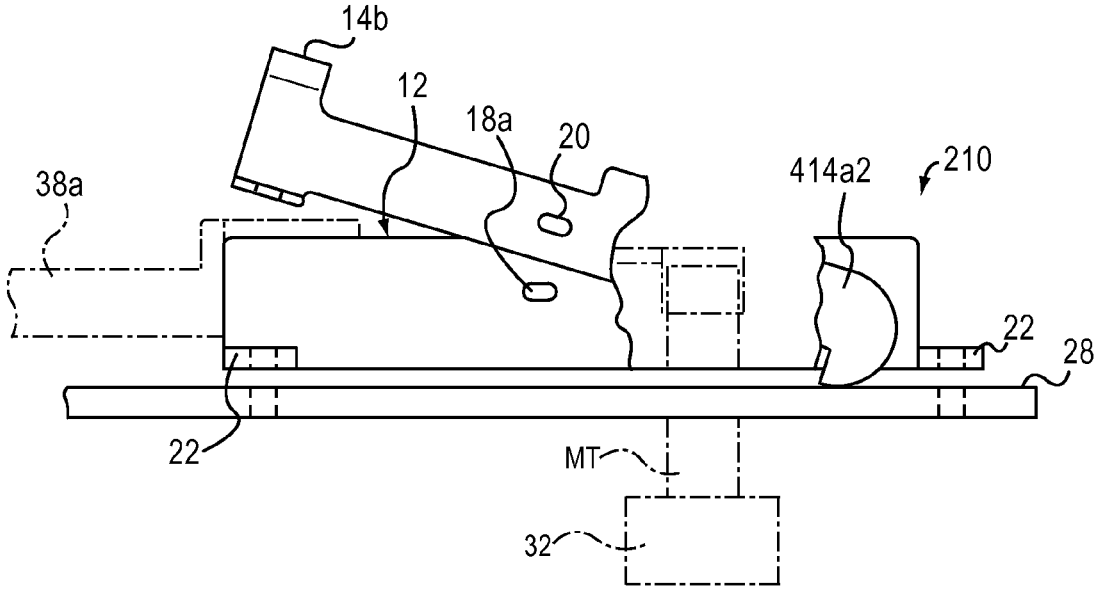
FIG. 13B is a partially broken-away side elevation view of the electrical connector of the present invention as shown in FIG. 13A diagrammatically illustrating the electrical terminals being partially withdrawn from matable engagement with one another.
Figure 14A:
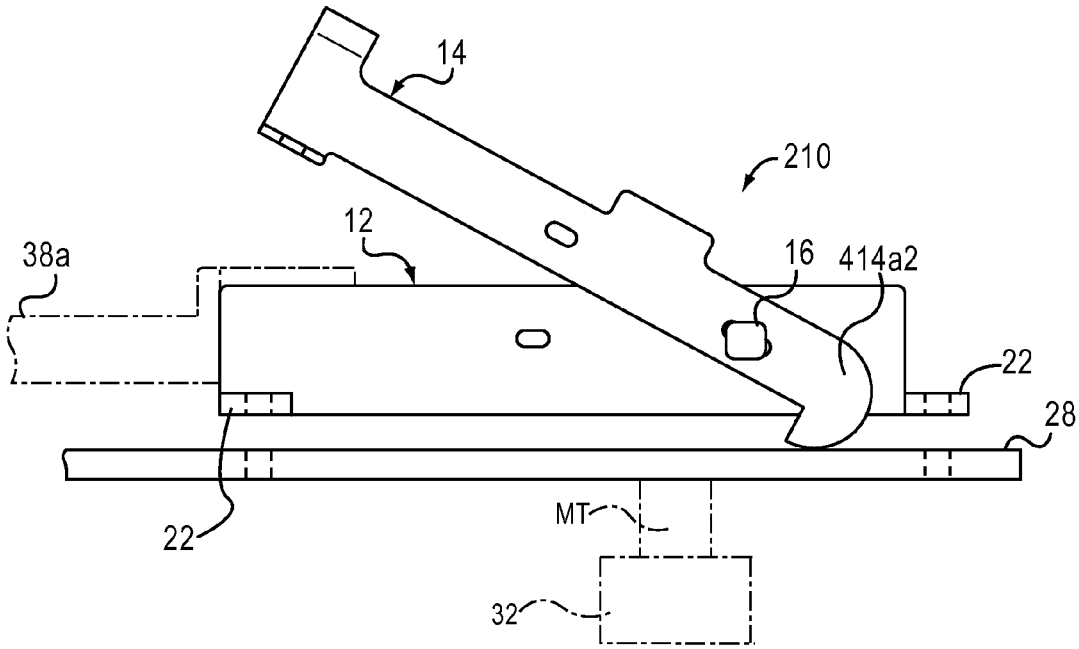
FIG. 14A is a side elevation view of the electrical connector of the present invention with the lever pivotably connected to the housing body in a second intermediate position with the cam element being in contact the surface and further separating the housing body and the surface from one another.
Figure 14B:
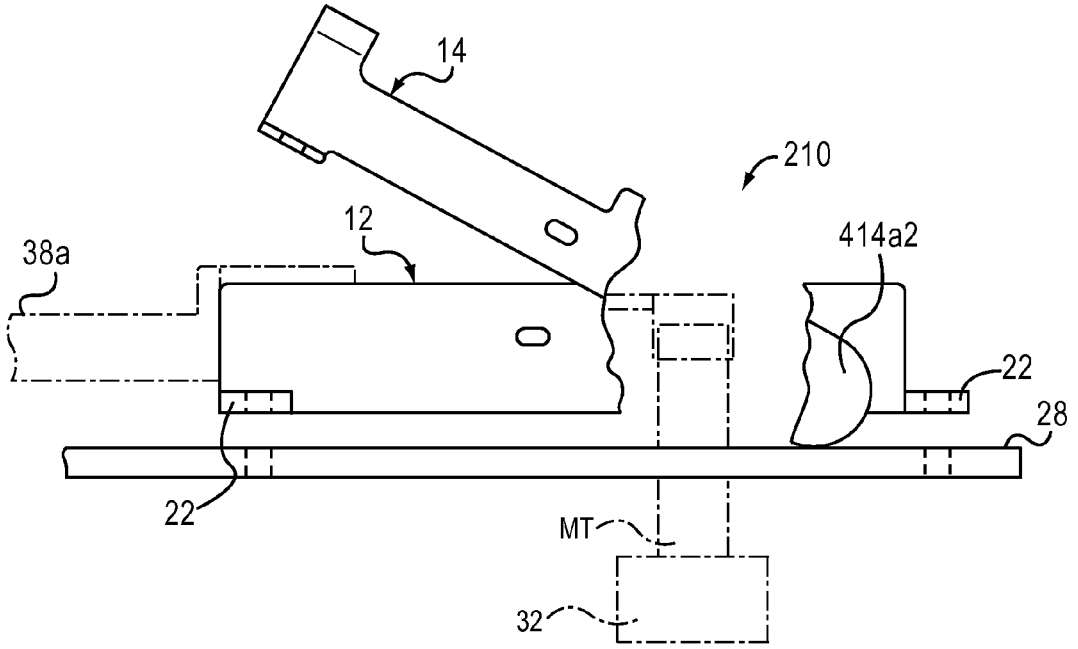
FIG. 14B is a partially broken-away side elevation view of the electrical connector of the present invention as shown in FIG. 14A diagrammatically illustrating the electrical terminals being further partially withdrawn from matable engagement with one another.
Figure 15A:
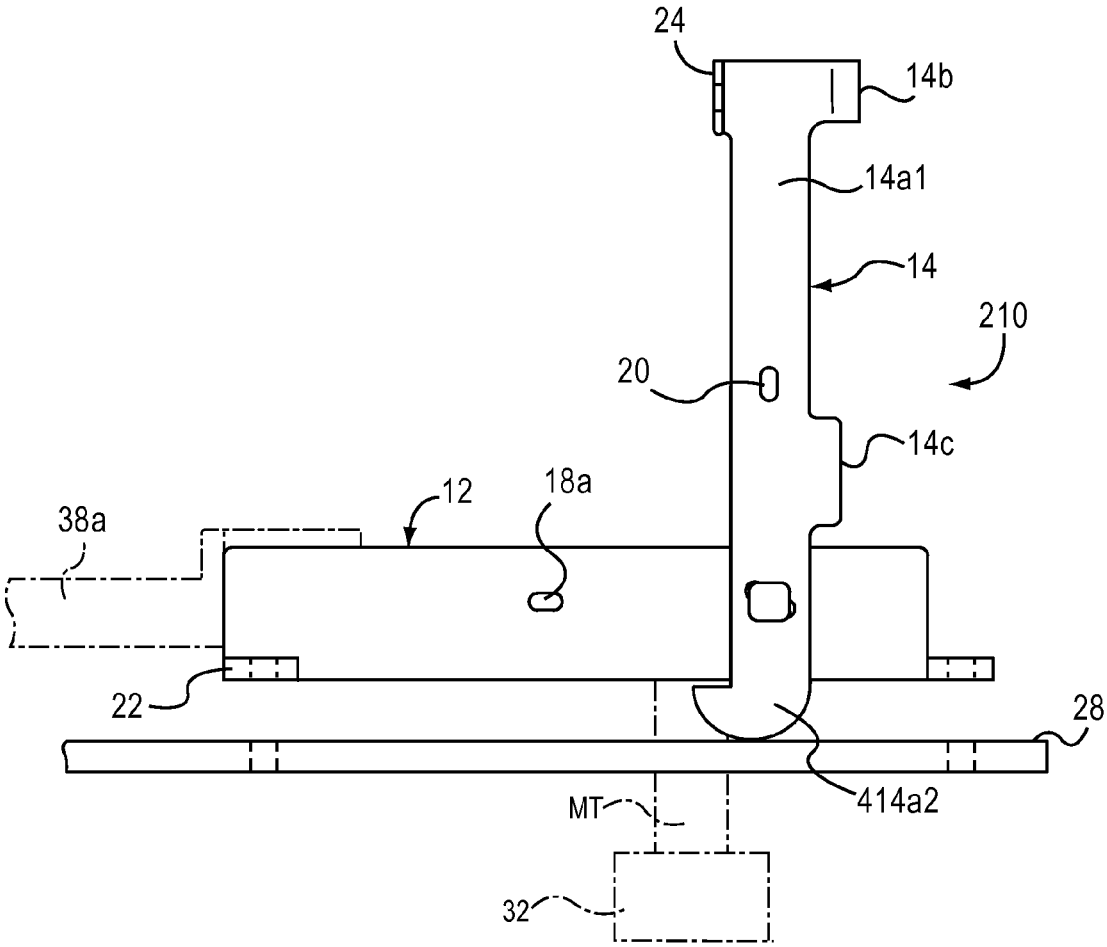
FIG. 15A is a side elevation view of the electrical connector of the present invention with the lever pivotably connected to the housing body in a second position with the cam element being in contact the surface and further separating the housing body and the surface from one another.
Figure 15B:
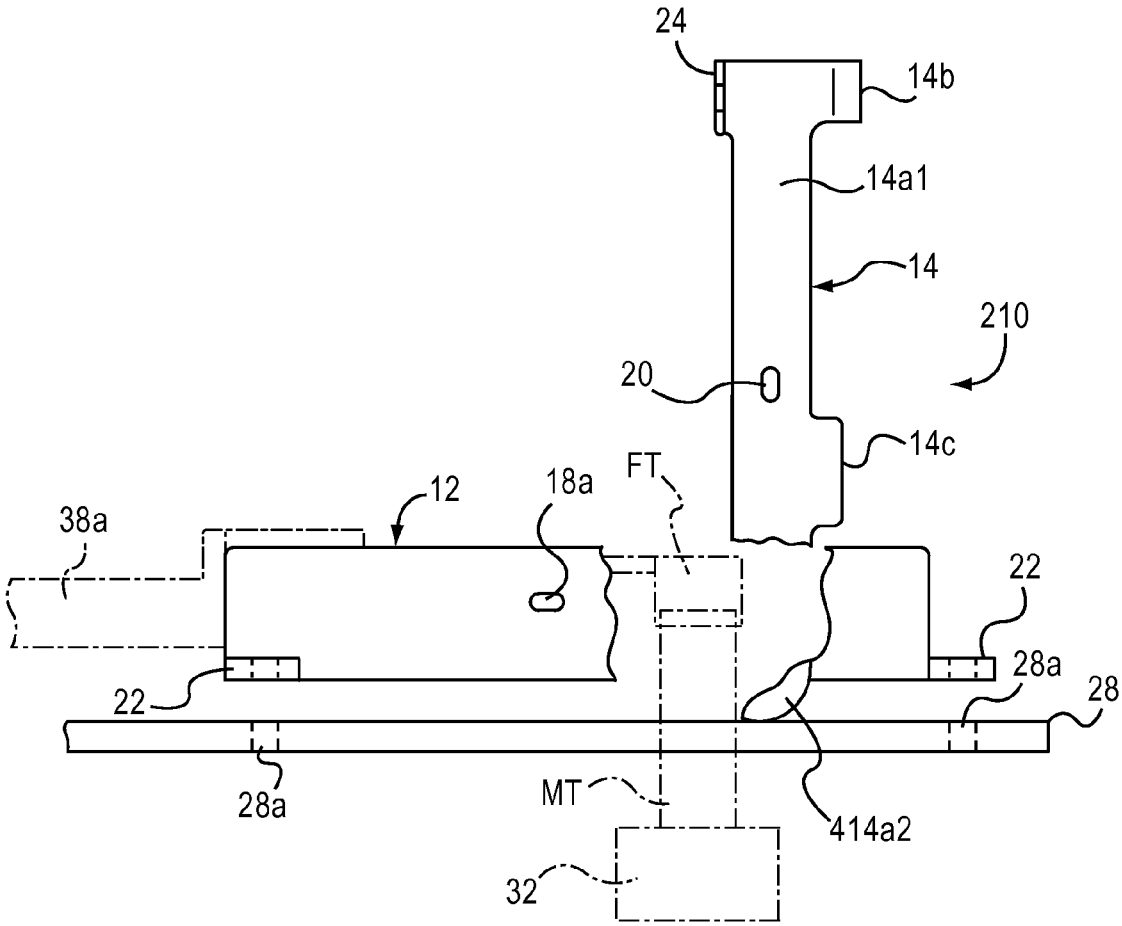
FIG. 15B is a partially broken-away side elevation view of the electrical connector of the present invention as shown in FIG. 15A diagrammatically illustrating the electrical terminals being at least further partially withdrawn from matable engagement with one another.

For the first exemplary embodiment of the electrical connector housing 10 of the present invention, the lever arm free end portion 14*a*1 is configured to be disposed apart from the surface 28 a distance D1 as shown in FIGS. 5A and 6A when the lever 14 is in the first position. With this arrangement, the lever 14 moves from the first position (FIGS. 1 and 5A-6B), to an intermediate position as shown in FIG. 7A. The intermediate position is located between the first position (FIGS. 1 and 5A-6B) and second position (FIGS. 8A-9). Subsequent to the lever 14 being in the first position and prior to the second position, the free end 14*a*2*a* initiates contact with the surface 28 at the intermediate position (FIG. 7A) and the free end 14*a*2*a* maintains contact with the surface 28 to the second position. Thus, from the intermediate position to the second position, the mated electrical terminals MET's, i.e., the mated female terminal FT and the male terminal MT, withdraw from substantial matable engagement with each other as serially shown in FIGS. 7B and 8B.

Once the mated electrical terminals MET's, i.e., the mated female terminal FT and the male terminal MT, are withdraw from substantial matable engagement with each other as shown in FIG. 8B, a user lifts the electrical connector housing away from the surface 28 as shown in FIG. 9 and disconnection, if any, of the matably engaged female and male terminals FT and MT, respectively, is completed.

Figure 16:
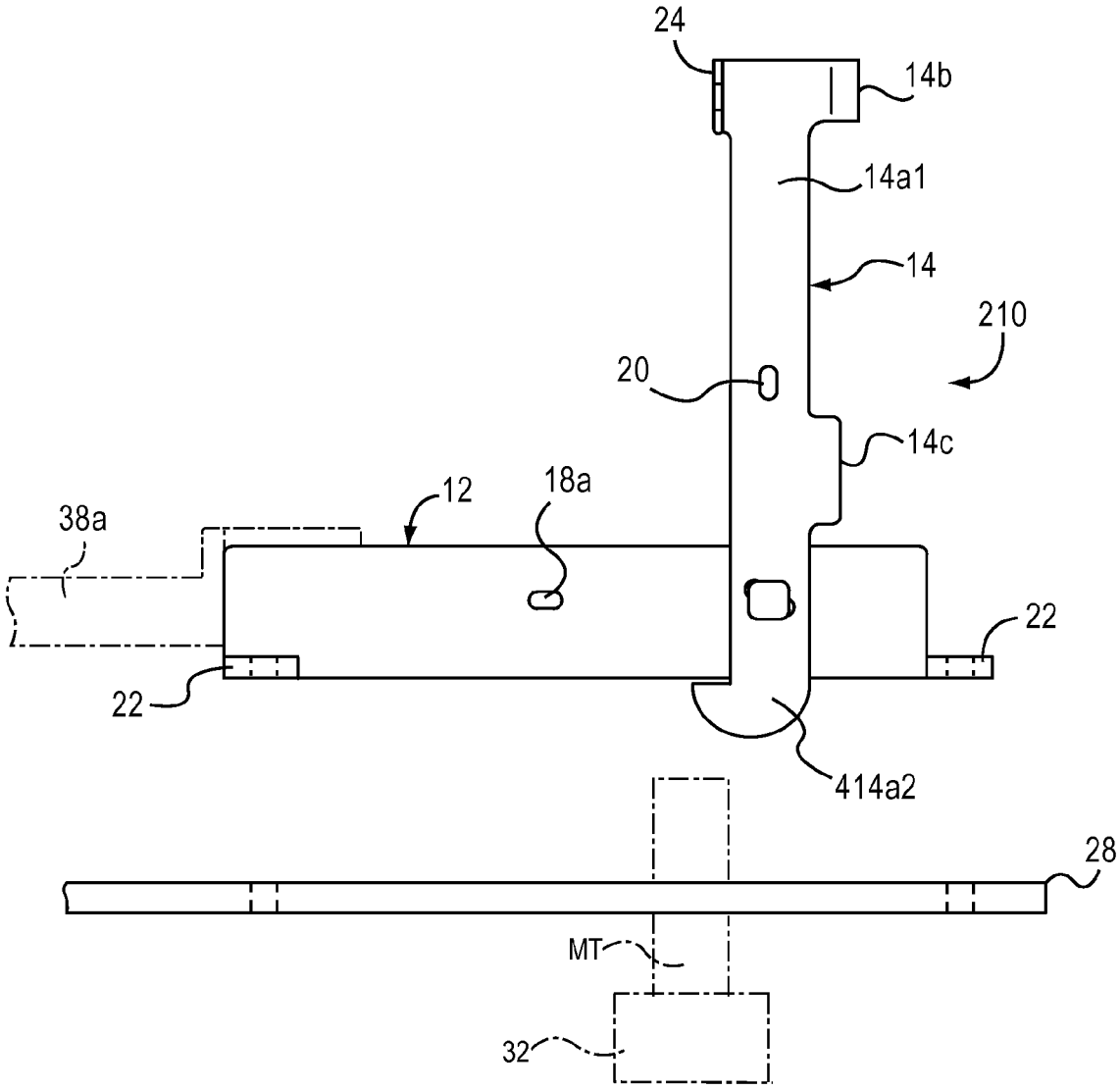
FIG. 16 is a side elevation view of the electrical connector of the present invention disposed apart from the surface and the electrical terminals being completely disengaged from one another.

A second exemplary embodiment of an electrical connector housing 210 is illustrated in FIGS. 10-16. The second exemplary embodiment of the electrical connector housing 210 is similar to the first exemplary embodiment of the electrical connector housing 10 discussed above. The main difference is that the lever arm free end portion 414*a*2 is configured as a cam element. The lever arm free and portion 414*a*2 is disposed adjacent the surface when the lever 14 is in the first position (FIGS. 10-12B). The lever 14 moves from the first position (FIGS. 10-12B) to the second position (FIGS. 15A-16), the lever arm free end portion 414*a*2 initiates contact with the surface 28 at or substantially near the first position (FIGS. 10-12B) and maintains contact with the surface 28 (at least FIGS. 13A-15B) to the second position shown in FIGS. 15A and B. In FIG. 16, the user lifts the electrical connector housing 210 away from the surface 28 and disconnection, if any remaining, of the matably engaged female and male terminals FT and MT, respectively, is completed.

A third exemplary embodiment of an electrical connector 310 of the invention is introduced in FIGS. 17-22. The electrical connector 310 is adapted for electrically connecting the wire assembly 30 and the power supply 32. The electrical connector 310 includes an electrical assembly 342 and an electrical assembly plate member 344. The electrical assembly 342 includes the electrical assembly mounting block 26 and the lever 14 discussed hereinabove. The electrical assembly 342 also includes the housing body 12 discussed above but the housing body 12 includes additional features as discussed in more detail below.

Figure 17:
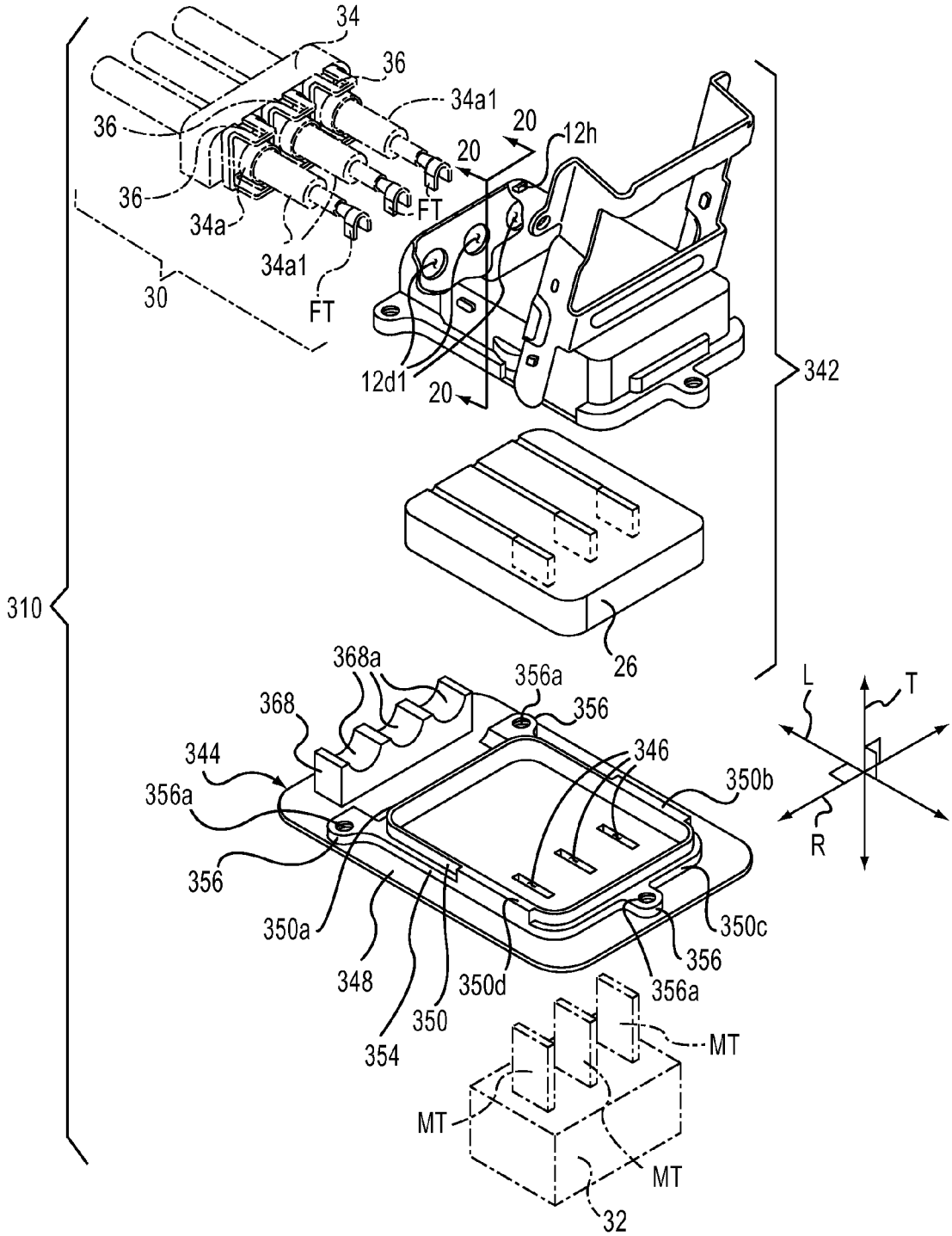
FIG. 17 is an exploded perspective view of a third exemplary embodiment of an electrical connector of the present invention including an electrical assembly having an electrical assembly mounting block, the housing body and a lever with the electrical assembly disposed apart from an electrical assembly plate member.
Figure 18:
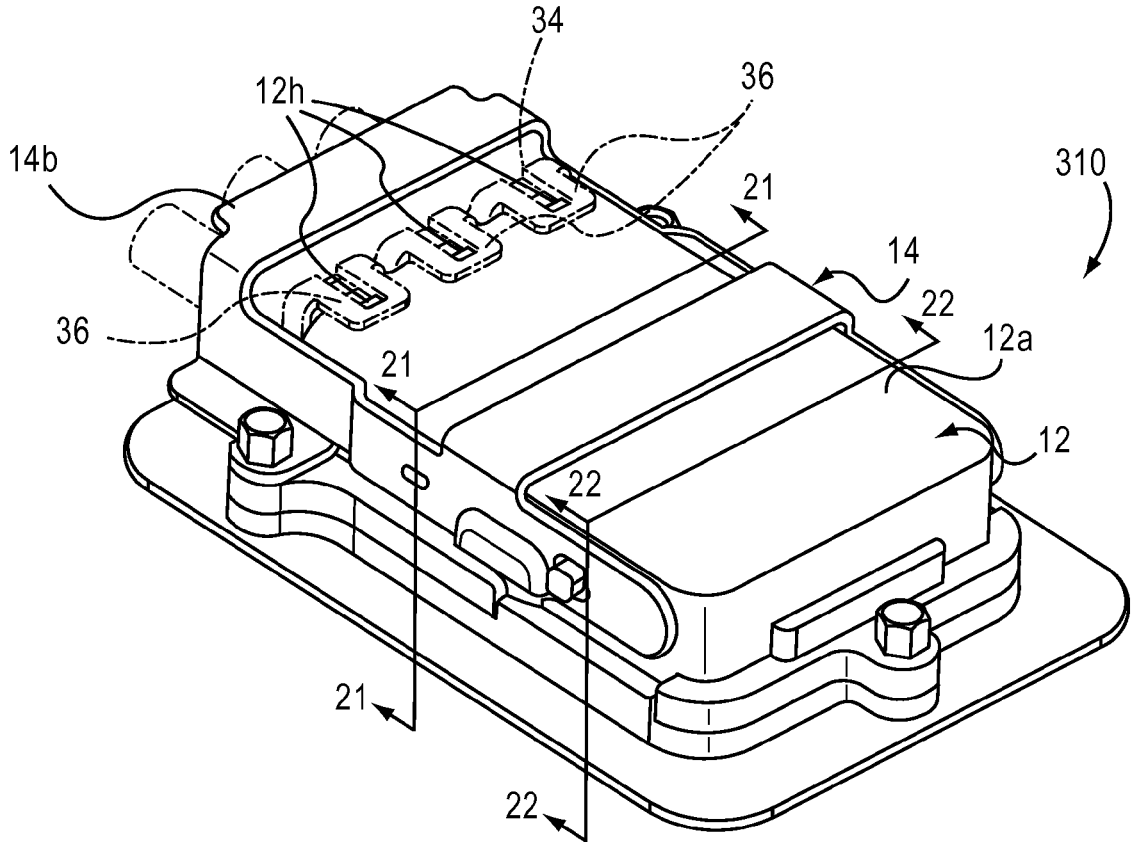
FIG. 18 is a perspective view of the third exemplary embodiment of an assembled electrical connector of the present invention shown in FIG. 17.

As depicted in FIG. 17, the electrical assembly plate member 344 is sized and adapted for the placement of the electrical assembly 343 thereon. The electrical assembly plate member 344 has a plurality of hot terminal holes 346 that are formed through the electrical assembly plate number 344. The plurality of hot terminal holes 346 is sized to receive respective ones of the plurality of male terminals MT, i.e. the hot terminals of the power source 32. With the lever in the first position, the electrical assembly 342 and the electrical assembly plate member 344 contact one another as shown in FIG. 18. As described above, the plurality of female blade-receiving terminals FT's receive respective ones of the plurality of male terminals MT's, i.e., the hot terminals, therein in a substantially matably engaged relationship with one another. The lever 14 is moved from the first position to the second position and the lever 14 is in contact with the electrical assembly plate member to cause the electrical connector assembly and the electrical assembly plate member to move apart from one another thus causing the plurality of female blade-receiving terminals and the plurality of hot terminals to be at least partially withdrawn from being in the substantially matably engaged relationship with one another.

In FIG. 17, the electrical assembly plate member 344 includes a base surface 348 and a barrier wall 350. The barrier wall 350 projects perpendicularly from the base surface 348 and is formed in an endless loop to define a mounting block receiving cavity 352. The base surface 348 located internally of the mounting block receiving cavity 352 includes the plurality of the hot terminal holes 346. As commonly known in the art, the plurality of the hot terminal holes 346 extend through the base surface 348 and are sized and spaced apart from one another to receive respective ones of the plurality of the male terminals MT, i.e. the hot terminals, therethrough.

Again, with reference to FIG. 17, the barrier wall 350 is oval shaped. Additionally, the barrier wall 350 has a first thin-walled barrier portion 350*a*, a first thick-walled barrier portion 350*b*, a second thin-walled barrier portion 350*c* and a second thin-walled barrier portion 350*d* which are serially and integrally connect to each other. The first thick-walled barrier portion 350*b* and second thick-walled barrier portion 350*d* are being disposed opposite one another. Also, the electrical assembly plate member includes an outer wall 354 that surrounds the barrier wall in a contacting manner. The outer wall 354 projects perpendicularly from the base surface 348. Further, the outer wall 354 is shorter than the barrier wall 350 disposed interiorly relative to the outer wall 354.

In FIG. 17, the electrical assembly plate member 344 includes at least three assembly plate member fastening tabs 356. Each one of the at least three assembly plate member fastening tabs 356 is connected to the outer wall 354 and the base surface 348 and extends outwardly relative to the outer wall 354. The at least three assembly plate member fastening tabs 356 have respective fastening holes 356*a* formed thereinto.

Figure 19:
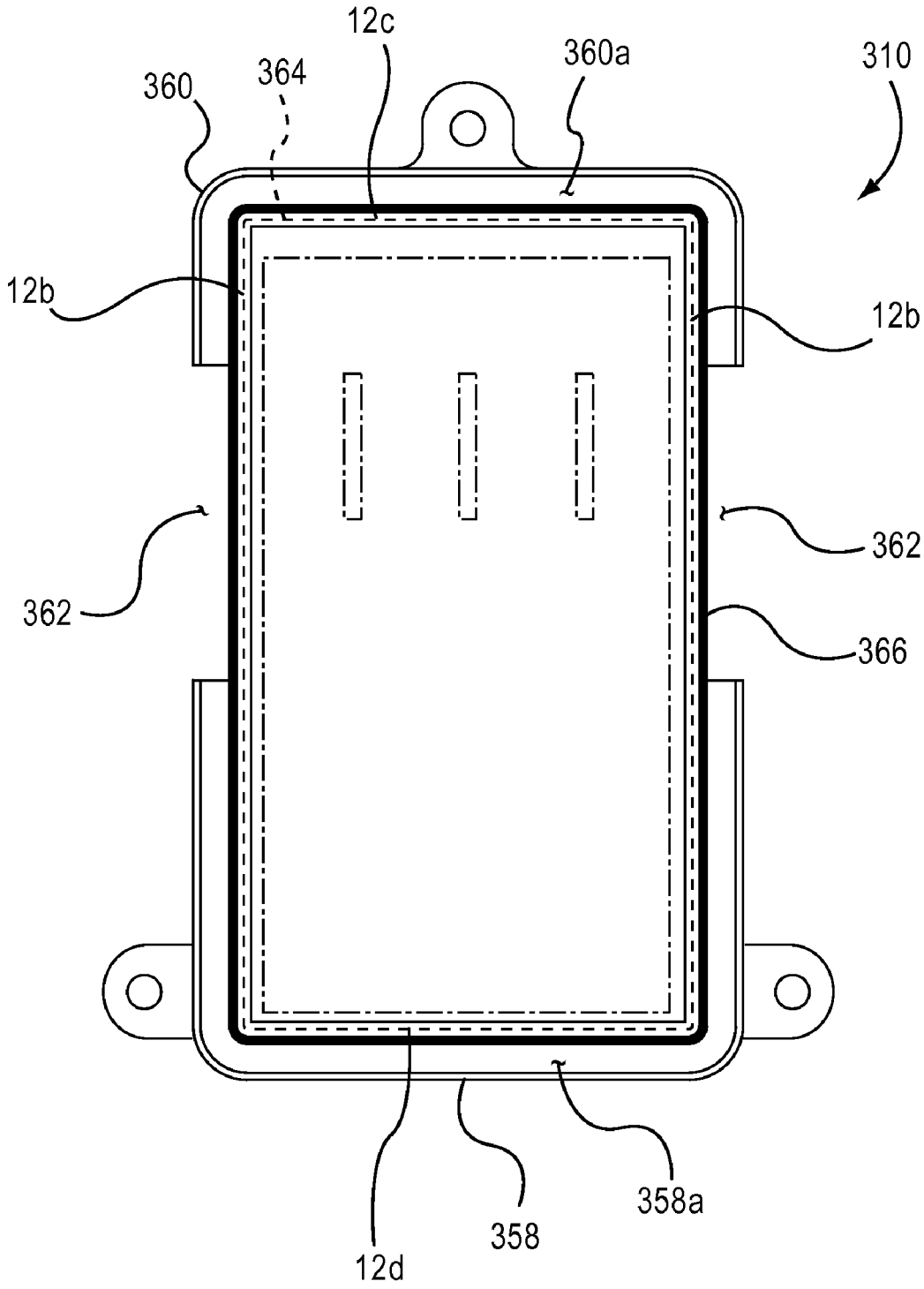
FIG. 19 is a bottom plan view of the third exemplary embodiment of the electrical connector of the present invention.

As best shown in FIGS. 17-22, the housing body 12, as mentioned above, includes additional features not shown in the first and second exemplary embodiments of the present invention. As best shown in FIG. 19, the housing body 12 includes a first channel-forming member 358 that defines a first channel 358*a* and a second channel-forming member 360 that defines a second channel 360*a*. The first channel-forming member 358 extends partially along one of the pair of the opposing side walls 12*b*, along the rearward side wall 12*d* and partially along a remaining one of the pair of opposing side walls 12*b*. The second channel-forming member 360 extends partially along one of the pair of the opposing side walls 12*b* opposite the first channel-forming member 358, along the forward side wall 12*c* and partially along a remaining one of the pair of opposing side walls 12*b*. Respective gaps are formed between opposing ones of the first channel-forming member 358 and the second channel-forming member 360 along respective ones of the pair of opposing side walls 12*b* as shown in FIG. 19 for illustration purposes. One gaps 362 is sized and positioned to slidably receive the first thick-walled barrier portion 350*b* and a remaining one of the gaps is sized and positioned to slidably receive the second thick-walled barrier portion 350*d*.

Figure 20:
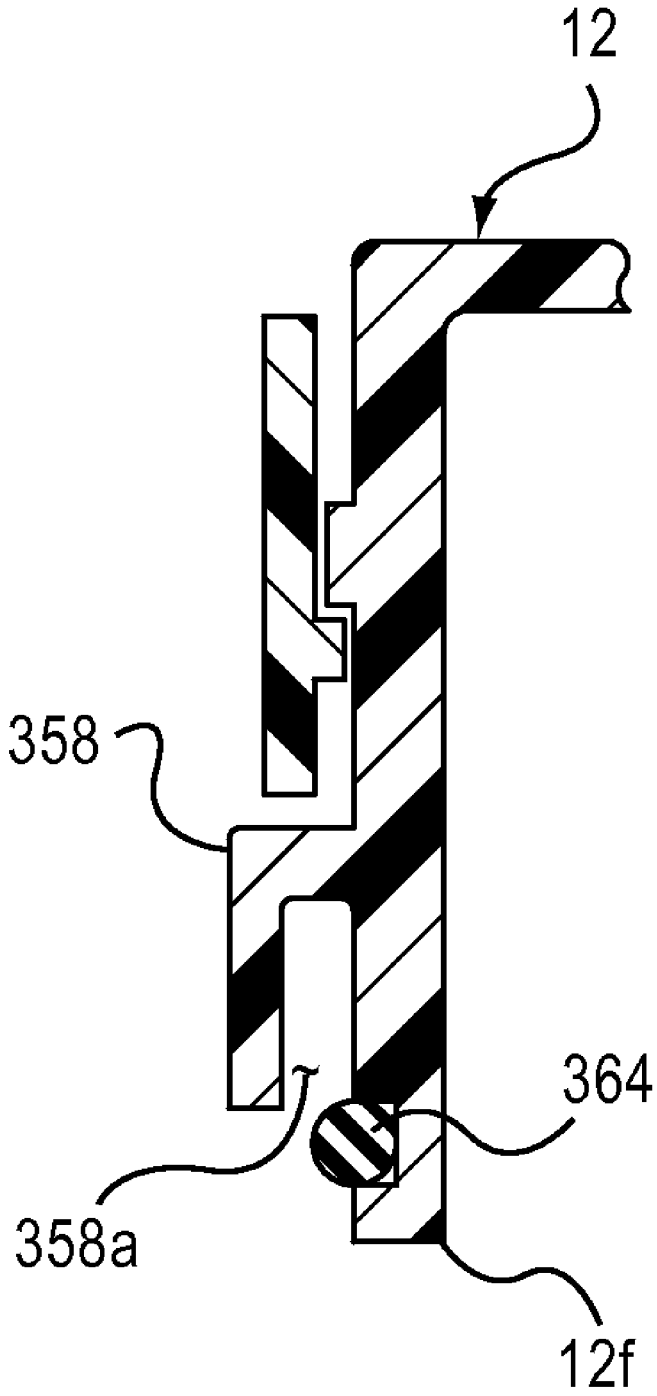
FIG. 20 is a partial perspective view of the third exemplary embodiment of the electrical connector of the present invention taken along line 20-20-20 in FIG. 17.
Figure 21:
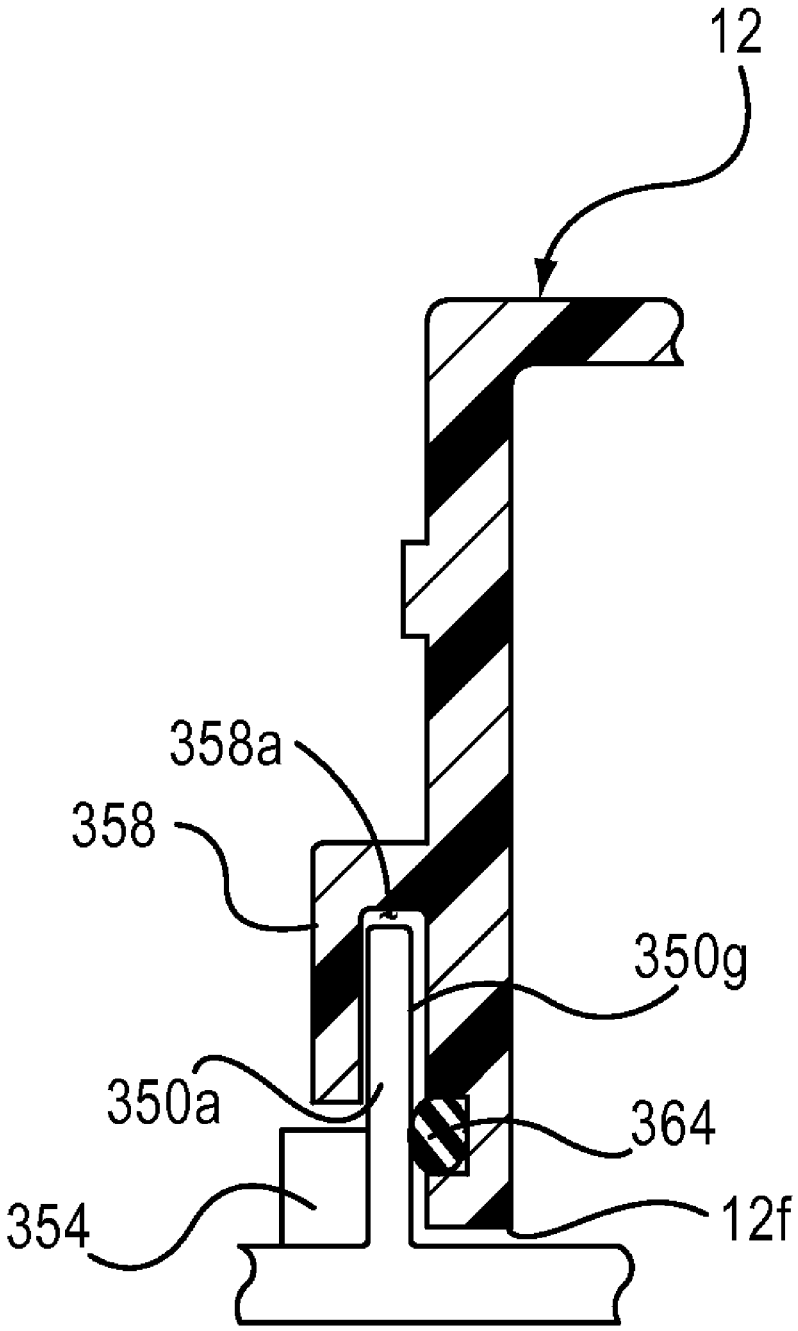
FIG. 21 is a partial perspective view of the third exemplary embodiment of the electrical connector of the present invention taken along line 21-21-21 in FIG. 18.
Figure 22:
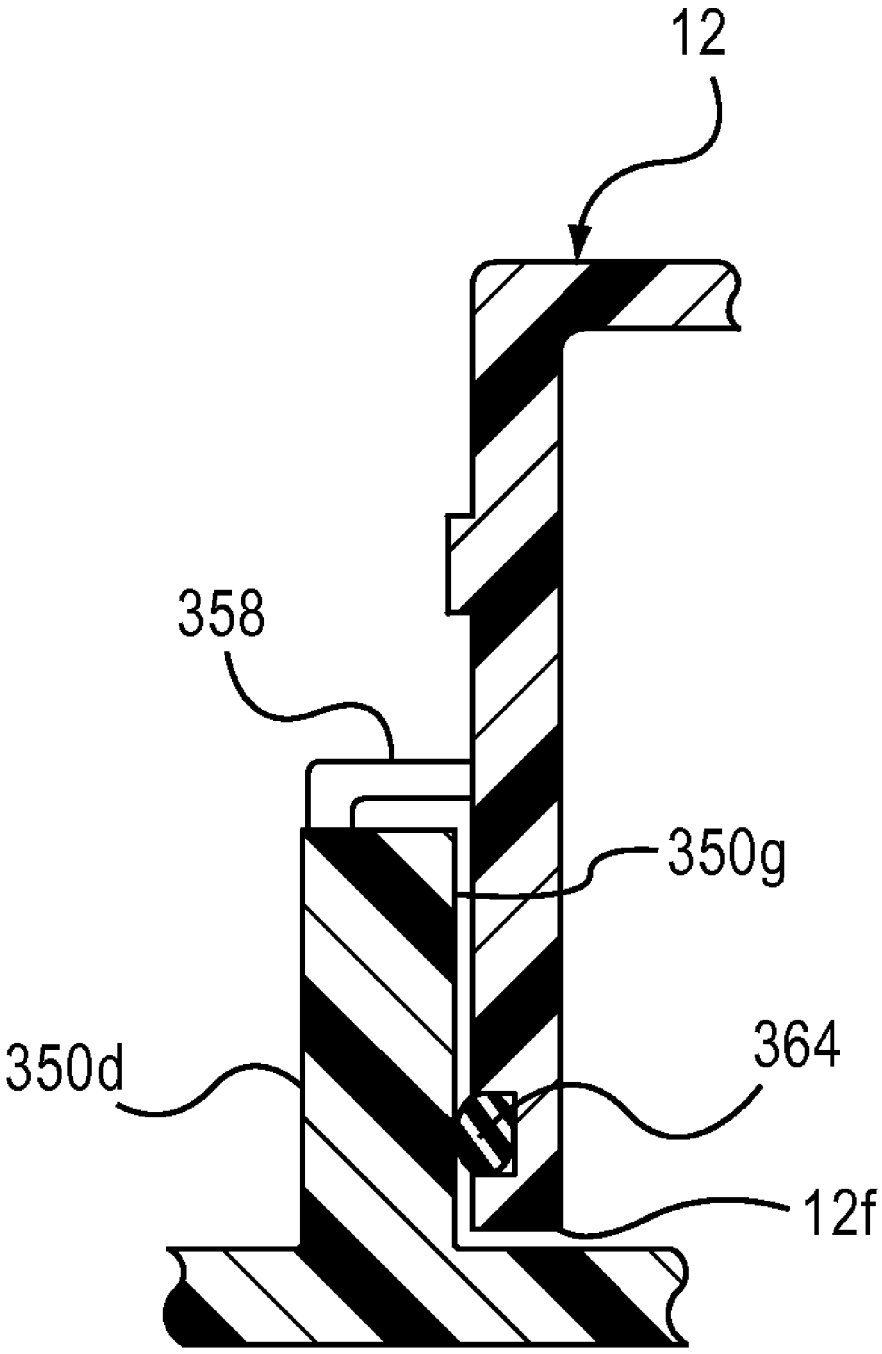
FIG. 22 is a partial perspective view of the third exemplary embodiment of the electrical connector of the present invention taken along line 22-22-22 in FIG. 18.

With reference to FIG. 19 in conjunction with FIGS. 20-22, the opposing side walls 12*b*, the forward side wall 12*c* and the rearward side wall 12*d* is formed with a continuous groove 364 that extends circumferentially therearound. In FIGS. 20-22, the continuous groove 364 is disposed between the first channel-forming member 358 and the opening 12*f* and the second channel-forming member 360 and the opening 12*f*. Furthermore, an O-ring seal 366 is sized to be disposed partially within the continuous groove 364. When the electrical assembly 342 is placed on the electrical assembly plate member 344, the O-ring seal 366 contacts an inner surface 350*g* of the barrier wall 350.

Again, with reference to FIG. 17, the electrical assembly plate member 344 includes a wire cradle 368 that has a scalloped upper surface 368*a*. The scalloped upper surface 368*a* permits a lower portion 34*a* of the wire assembly block retainer 34 to rest thereon. More specifically, the lower portion 34*a* of the wire assembly block retainer 34 includes a series of protuberances 34*a*1 that project therefrom and that are sized and adapted to be received in the scalloped upper surface 368*a* of the wire cradle 368 in a close fitting relationship.

As shown in FIGS. 2, 17 and 18, the base panel member includes a plurality of latch projections 12*h* that project outwardly therefrom. Respective ones of the plurality of latch projections 12*h* are operative to be releasably captured by respective ones of the plurality of flexible latches 36 which are integrally connected to the wire assembly block retainer 34. In this way, the wire assembly block retainer 34 is releasably connected to the housing body 12. As is known in the art, each one of the rearward side wall holes is sized to receive a respective one of the plurality of wire structures therethrough. And, as best shown in FIG. 18, when the lever 14 is in the first position, the main cross member 14*b* extends beyond the housing body 12 and covers the wire assembly block retainer 34.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. An electrical connector housing adapted for moving an electrical assembly mounting block away from a surface while at least partially withdrawing mated electrical terminals from one another, the electrical connector housing comprising:

a housing body connected to and covering the electrical assembly mounting block; and a lever pivotably connected to the housing body and operative to angularly move about a pivot axis from a first position to a second position, wherein, with the lever in the first position, the electrical connector housing and the surface contact one another and the electrical terminals are substantially matably engaged with one another and, moving the lever from the first position to the second position, the lever being in contact with the surface causes the electrical connector housing and the surface to move apart from one another thus causing the electrical terminals to be at least partially withdrawn from being substantially matably engaged with one another and wherein each one of the pair of lever arms includes a lever arm free end portion formed in an arcuate configuration such that, when moving the lever from the first position to the second position, respective ones of the lever arm free end portions are in constant point contact with the surface.

2. An electrical connector housing according to claim 1, wherein the lever having a pair of lever arms disposed apart from and extending parallel to one another and a main cross-member interconnecting the pair of lever arms to form a generally U-shaped configuration.

3. An electrical connector housing according to claim 2, wherein the pair of lever arms straddle the housing body.

4. An electrical connector housing according to claim 3, wherein, in the first position, the main cross-member extends beyond the housing body.

5. An electrical connector housing according to claim 2, further comprising a pair of pivot pins, respective ones of the pair of pivot pins pivotably connect respective ones of the pair of lever arms to the housing body.

6. An electrical connector housing according to claim 5, wherein each one of the pair of lever arms includes a lever arm extension portion, the lever arm extension portion extending between the main cross-member and the respective pivot pin, the lever arm free end portion extending from the respective pivot pin and terminating in a free end, the free end contacting the surface when the lever angularly moves from the first position to the second position.

7. An electrical connector housing according to claim 6, wherein the free end is configured to be disposed apart from the surface when the lever is in the first position such that the lever moves from the first position, to an intermediate position being between the first and second position and, subsequent to the first position and prior to the second position, the free end initiating contact with the surface at the intermediate position and maintaining contact with the surface to the second position.

8. An electrical connector housing according to claim 6, wherein the lever arm free end portion is configured to be disposed adjacent the surface when the lever is in the first position such that the lever moves from the first position to the second position, the free end initiating contact with the surface at or substantially near the first position and maintains contact with the surface to the second position.

9. An electrical connector housing according to claim 2, further comprising a secondary cross-member interconnecting the pair of lever arms and disposed between the main cross-member and the pivot axis.

10. An electrical connector housing according to claim 2, further comprising at least one retainer device operative for releasably retaining the lever in the first position.

11. An electrical connector housing according to claim 10, wherein the at least one retainer device includes a housing boss connected the housing body and a lever boss connected to one of the pair of lever arms such that, when the lever is in the first position, the housing boss and the lever boss overlap and contact one another in a manner to inhibit angular movement of the lever from the first position.

12. An electrical connector housing according to claim 1, wherein the housing body includes at least three housing fastener tabs connected to and projecting laterally from the housing body, each housing fastener tab having a fastener tab hole extending therethrough.

13. An electrical connector housing according to claim 12, wherein the lever includes a pair of lever fastener tabs, respective ones of the pair of lever fastener tabs being in registration with two selected ones of the at least three housing fastener tabs when the lever is in the first position.

14. An electrical connector housing, comprising:

a housing body extending along and about a longitudinal axis, a lateral axis and a transverse axis perpendicularly intersecting one another to form a Cartesian coordinate system, the longitudinal axis defining a longitudinal direction, the lateral axis defining a lateral direction and the transverse axis defining a transverse direction, the housing body having a generally rectangular base panel member and pair of opposing side walls connected to the base panel member, a forward side wall connected between the pair of opposing sidewalls and to the base panel member and a rearward side wall disposed apart from the forward side wall and connected between the pair of opposing side walls and the base panel to form an opening into a generally box-shaped cavity; and a lever having a pair of lever arms disposed apart from and extending parallel to one another and a main cross-member interconnecting the pair of lever arms to form a generally U-shaped configuration, the pair of lever arms straddle the base panel member with respective ones of the pair of lever arms pivotably connected to respective ones of the pair of opposing side walls for angularly moving about a pivot axis to and between a first position where the pair of lever arms extend generally parallel to the pair of opposing side walls and a second position where the pair of lever arms are disposed angularly relative to the pair of opposing side walls, wherein each one of the pair of lever arms includes a lever arm free end portion formed in an arcuate configuration.

15. An electrical connector housing according to claim 14, wherein the main cross member extends beyond the rearward wall when the lever is in the first position.

16. An electrical connector housing according to claim 14, further comprising a pair of pivot pins, respective ones of the pair of pivot pins pivotably connect respective ones of the pair of lever arms to respective ones of the pair of opposing side walls.

17. An electrical connector housing according to claim 16, wherein each one of the pair of lever arms includes a lever arm extension portion, the lever arm extension portion extending between the main cross-member and the respective pivot pin, the lever arm free end portion extending from the respective pivot pin and terminating in a free end.

18. An electrical connector housing according to claim 14, further comprising a secondary cross-member interconnecting the pair of lever arms and disposed between the main cross-member and the pivot axis.

19. An electrical connector housing according to claim 14, further comprising at least one retainer device operative for releasably retaining the lever in the first position.

20. An electrical connector housing according to claim 19, wherein the at least one retainer device includes a housing boss connected the housing body and a lever boss connected to one of the pair of lever arms such that, when the lever is in the first position, the housing boss and the lever boss overlap and contact one another in a manner to inhibit angular movement of the lever from the first position.

21. An electrical connector housing according to claim 14, wherein the housing body includes at least three housing fastener tabs connected to and projecting from the housing body, each housing fastener tab having a housing fastener tab hole extending therethrough and wherein the lever includes a pair of lever fastener tabs, each one of the pair of lever fastener tabs having lever fastener tab hole formed therethrough, respective ones of the pair of lever fastener tabs are positioned on two selected ones of the at least three housing fastener tabs and respective ones of the housing fastener tab holes and lever fastener tab holes being in registration with one another when the respective ones of the pair of lever fastener tabs are positioned on the two selected ones of the at least three housing fastener tabs.

22. An electrical connector adapted for electrically connecting a wire assembly and a power supply, the wire assembly including a wire assembly block retainer having a plurality of flexible latches and retaining a plurality of wire structures thereto, each one of the plurality of wire structures having a wire and with a female blade-receiving terminal electrically and mechanically attached to a terminal end of respective ones of the wires, the power supply having a plurality of hot terminals operably connected thereto, the electrical connector comprising:

an electrical assembly including an electrical assembly mounting block, a housing body and a lever, the electrical assembly mounting block sized and adapted to receive and retain the plurality of wire structures and the female blade-receiving terminals therein;

the housing body connected to and covering the electrical assembly mounting block, the housing body having a generally rectangular base panel member and pair of opposing side walls connected to the base panel member, a forward side wall connected between the pair of opposing sidewalls and to the base panel member and a rearward side wall disposed apart from the forward side wall and connected between the pair of opposing side walls and the base panel to form an opening into a generally box-shaped cavity sized to receive the electrical assembly mounting block therein;

the lever pivotably connected to the connector body and operative to angularly move about a pivot axis from a first position to a second position, the lever having a pair of lever arms disposed apart from and extending parallel to one another and a main cross-member interconnecting the pair of lever arms to form a generally U-shaped configuration, the pair of lever arms straddling the base panel member, respective ones of the pair of lever arms being pivotably connected to respective ones of the pair of opposing side walls; and an electrical assembly plate member sized and adapted for the placement of the electrical assembly thereon, the electrical assembly plate member having a plurality of hot terminal holes formed therethrough and sized to receive respective ones of the plurality of hot terminals, wherein, with the lever in the first position, the electrical connector assembly and the electrical assembly plate member contact one another and the plurality of female blade-receiving terminals receiving respective ones of the plurality of hot terminals therein in a substantially matably engaged relationship with one another and, moving the lever from the first position to the second position, the lever being in contact with the electrical assembly plate member to cause the electrical connector assembly and the electrical assembly plate member to move apart from one another thus causing the plurality of female blade-receiving terminals and the plurality of hot terminals to be at least partially withdrawn from being in the substantially matably engaged relationship with one another, wherein each one of the pair of lever arms includes a lever arm free end portion formed in an arcuate configuration such that, when moving the lever from the first position to the second position, respective ones of the lever arm free end portions are in constant point contact with the electrical assembly plate member.

23. An electrical connector according to claim 22, wherein the electrical assembly plate member includes a base surface and a barrier wall projecting from the base surface and formed in an endless loop to define a mounting block receiving cavity.

24. An electrical connector according to claim 23, wherein the base surface internally of the mounting block receiving cavity includes a plurality of terminal holes extending therethrough and sized and spaced apart from one another to receive respective ones of the plurality of hot terminals therethrough.

25. An electrical connector according to claim 24, wherein the barrier wall is oval shaped and has a first thin-walled barrier portion, a first thick-walled barrier portion, a second thin-walled barrier portion and a second thin-walled barrier portion serially and integrally connect to each other, the first and second thick-walled barrier portions being disposed opposite one another.

26. An electrical connector according to claim 25, wherein the electrical assembly plate member includes an outer wall surrounding the barrier wall and projecting from the base surface, the outer wall being shorter than the barrier wall.

27. An electrical connector according to claim 25, wherein the electrical assembly plate member includes at least three assembly plate member fastening tabs connected to the outer wall and the base surface and extending outwardly relative to the outer wall, the at least three assembly plate member fastening tabs having respective fastening holes formed thereinto.

28. An electrical connector according to claim 25, wherein the housing body includes a first channel-forming member defining a first channel and a second channel-forming member defining a second channel, the first channel-forming member extending partially along one of the pair of the opposing side walls, along the rearward side wall and partially along a remaining one of the pair of opposing side walls, the second channel-forming member extending partially along one of the pair of the opposing side walls opposite the first channel-forming member, along the forward side wall and partially along a remaining one of the pair of opposing side walls, respective gaps formed between opposing ones of the first and second channel-forming members along respective ones of the pair of opposing side walls, one gaps sized and positioned to slidably receive the first thick-walled barrier portion and a remaining one of the gaps sized and positioned to slidably receive the second thick-walled barrier portion.

29. An electrical connector according to claim 28, wherein the opposing side walls, the forward side wall and the rearward side wall is formed with a continuous groove extending circumferentially therearound.

30. An electrical connector according to claim 29, wherein the continuous groove is disposed between both the first channel-forming member and the second channel-forming member and the opening.

31. An electrical connector according to claim 30, further comprising an O-ring seal sized to be disposed partially within the continuous groove.

32. An electrical connector according to claim 31, wherein, when the electrical assembly plate member is placed on the electrical assembly, the O-ring seal contacts an inner surface of the barrier wall.

33. An electrical connector according to claim 22, wherein the electrical assembly plate member includes a wire cradle having a scalloped upper surface.

34. An electrical connector according to claim 22, wherein the base panel member includes a plurality of latch projections projecting therefrom, respective ones of the plurality of latch projections operative to be releasably captured by respective ones of the plurality of flexible latches such that the wire assembly block retainer is releasably connected to the housing body.

35. An electrical connector according to claim 34, wherein the rearward side wall has a plurality of rearward side wall holes formed therethough, each one of the rearward side wall holes is sized to receive a respective one of the plurality of wire structures therethrough.

36. An electrical connector according to claim 34, wherein, in the first position, the main cross member extends beyond the housing body and covers the wire assembly block retainer.

37. An electrical connector housing according to claim 22, further comprising a pair of pivot pins, respective ones of the pair of pivot pins pivotably connect respective ones of the pair of lever arms to the housing body.

38. An electrical connector housing according to claim 37, wherein each one of the pair of pivot arms includes a pivot arm extension portion and a pivot arm lever portion, the pivot arm extension extending between the main cross-member and the respective pivot pin, the pivot arm lever portion extending from the respective pivot pin and terminating in a free end lever portion, the free end lever portion contacting the electrical assembly plate member when the lever angularly moves from the first position to the second position.

39. An electrical connector housing according to claim 22, further comprising a secondary cross-member interconnecting the pair of lever arms and disposed between the main cross-member and the pivot axis, the secondary cross-member spanning the base panel member.

40. An electrical connector housing according to claim 22, further comprising at least one retainer device operative for releasably retaining the lever in the first position.

41. An electrical connector housing according to claim 40, wherein the at least one retainer device includes a housing boss connected the housing body and a lever boss connected to one of the pair of lever arms such that, when the lever is in the first position, the housing boss and the lever boss overlap and contact one another in a manner to inhibit angular movement of the lever from the first position.

* * * * *